US012679622B2

(12) United States Patent
Vallabhaneni et al.

(10) Patent No.: US 12,679,622 B2
(45) Date of Patent: Jul. 14, 2026

(54) CONTAINERS WITH INFLATABLE DUNNAGE

(71) Applicant: Alphacath Limited, Ellesmere Port (GB)

(72) Inventors: Srinivasa Rao Vallabhaneni, Ellesmere Port (GB); Daniel Isler, Liverpool (GB); James Dickson, Liverpool (GB); Rafael Negrillo Garcia-Figueras, Liverpool (GB)

( * ) Notice: Subject to any disclaimer, the term of this patent is extended or adjusted under 35 U.S.C. 154(b) by 4 days.

(21) Appl. No.: 18/880,527

(22) PCT Filed: May 2, 2023

(86) PCT No.: PCT/GB2023/051159
§ 371 (c)(1),
(2) Date: Dec. 31, 2024

(87) PCT Pub. No.: WO2024/009050
PCT Pub. Date: Jan. 11, 2024

(65) Prior Publication Data

US 2025/0223096 A1 Jul. 10, 2025

(30) Foreign Application Priority Data

Jul. 5, 2022 (GB) ..... 2209827

(51) Int. Cl.
*B65D 81/05* (2006.01)
*B65D 21/08* (2006.01)
(Continued)

(52) U.S. Cl.
CPC ..... *B65D 81/052* (2013.01); *B65D 21/086* (2013.01); *B65D 43/164* (2013.01); *B65D 43/22* (2013.01)

(58) Field of Classification Search
CPC ..... B65D 81/052; B65D 21/086; B65D 2519/008; B65D 85/30; B65D 43/164; B65D 43/22
(Continued)

(56) References Cited

U.S. PATENT DOCUMENTS 5,339,602 A 8/1994 Landers et al.
10,968,012 B1 * 4/2021 Ward ..... B65D 11/1833
(Continued)

FOREIGN PATENT DOCUMENTS

CN 202414444 U 9/2012
CN 105209351 * 12/2015
(Continued)

OTHER PUBLICATIONS

European Patent Office, International Search Report for PCT App. No. PCT/GB2023/051159, Oct. 10, 2023, pp. 1-6.
(Continued)

*Primary Examiner* — Rafael A Ortiz
(74) *Attorney, Agent, or Firm* — Cahn & Samuels, LLP

(57) ABSTRACT

The present invention provides a container (200) comprising a container body (202) which forms an internal cavity for receiving content. The container (200) has an opening (236) through which the content is able to be inserted to and removed from the internal volume. A closure (204), which may be in the form of a lid, is movable with respect to the container body (202) between a closed position in which it closes the opening (236) and an open position in which the opening (236) is uncovered. A locking member (280) is movable between a lock position and an unlock position and is configured when in the lock position to lock the closure in its closed position. Moving the locking member to the unlock position releases the closure (204) to open the container. Inflatable dunnage (256) is provided in the inter-
(Continued)

nal volume and is configured to be inflated by injection of fluid, which may be gas. An exhaust port (290) communicates with the inflatable dunnage and is provided with an exhaust port shutoff arrangement (278) having a closed state in which it closes the exhaust port (290) and an open state in which it opens the exhaust port. The locking member (280) is configured to cooperate with the exhaust port shutoff arrangement (278) such that moving the locking member from its lock position to its unlock position causes the exhaust port shutoff arrangement (278) to change from its closed state to its open state, whereby pressure in the inflatable dunnage is automatically released through the exhaust port prior to opening of the container.

20 Claims, 21 Drawing Sheets

(51) Int. Cl.
*B65D 43/16* (2006.01)
*B65D 43/22* (2006.01)

(58) Field of Classification Search
USPC ..... 206/521, 522, 600
See application file for complete search history.

(56) References Cited

U.S. PATENT DOCUMENTS

| | | | | |
|---|---|---|---|---|
| 11,072,479 | B1 * | 7/2021 | David | B65D 81/052 |
| 11,427,385 | B1 * | 8/2022 | Cutter | B65D 25/101 |
| 2007/0221530 | A1 | 9/2007 | Lee | |
| 2008/0203090 | A1 | 8/2008 | Dickinson | |
| 2011/0272419 | A1 * | 11/2011 | Vanderberg | B65D 21/086 220/666 |
| 2012/0269594 | A1 | 10/2012 | Starnes | |
| 2018/0177344 | A1 * | 6/2018 | Bagley | B65D 21/086 |
| 2019/0068027 | A1 | 2/2019 | Kim | |
| 2022/0250823 | A1 | 8/2022 | An et al. | |

FOREIGN PATENT DOCUMENTS

| | | | | |
|---|---|---|---|---|
| CN | 107310814 | A | | 11/2017 |
| CN | 107777061 | | * | 3/2018 |
| CN | 108128519 | A | | 6/2018 |
| CN | 108557183 | B | | 5/2020 |
| CN | 210635066 | U | | 5/2020 |
| CN | 211253673 | U | | 8/2020 |
| CN | 215754172 | U | | 2/2022 |
| CN | 114194611 | | * | 3/2022 |
| DE | 19548704 | A1 | | 6/1997 |
| EP | 3828102 | A1 | | 6/2021 |

OTHER PUBLICATIONS

European Patent Office, Written Opinion for PCT App. No. PCT/GB2023/051159, Oct. 10, 2024, pp. 1-8.
European Patent Office, English abstract for CN107310814A, retrieved on Dec. 20, 2024.
European Patent Office, English abstract for CN108128519A, retrieved on Dec. 20, 2024.
European Patent Office, English abstract for CN108557183A, retrieved on Dec. 20, 2024.
European Patent Office, English abstract for CN202414444U, retrieved on Dec. 20, 2024.
European Patent Office, English abstract for CN210635066U, retrieved on Dec. 20, 2024.
European Patent Office, English abstract for CN211253673U, retrieved on Dec. 20, 2024.
European Patent Office, English abstract for CN2157544172U, retrieved on Dec. 20, 2024.
European Patent Office, English abstract for DE19548704A1, retrieved on Dec. 20, 2024.

* cited by examiner

CONTAINERS WITH INFLATABLE DUNNAGE

TECHNICAL FIELD

The present disclosure relates to the field of containers provided with dunnage to protect the container's content from damage. Such containers are particularly, although not exclusively, suited to use in delivery of products.

BACKGROUND

There is a wide variety of containers used for holding, storing, and shipping goods. Such containers include a large variety of cartons and boxes. Perhaps the most common type of container employed by the shipping industry is the one-time-use carton constructed, for example, of paperboard or cardboard. Typically the content to be shipped is placed in the container, whose remaining internal volume is then filled with loose dunnage which may for example comprise expanded-polystyrene chips or shredded paper. Sometimes the dunnage comprises a resilient material such as foam, shaped to complement the contours and size of the contents.

The conventional shipping box is typically sealed with a one-time-use means such as self-adhesive tape, staples, knotted twine, etc.

Once the container reaches its shipping destination, the recipient typically discards both the container and the associated dunnage which is wasteful and environmentally damaging. Some forms of dunnage are non-recyclable, and even where materials such as cardboard are recycled there is an environmental cost in remanufacturing, which could be avoided were the container instead to be reused. Recyclable components do not always get recycled. Even recycling can be done only a small number of times, and recycling itself has an energy footprint. Non-recycled and non-recyclable elements add to a different type of environmental burden, namely pollution.

Typically, existing delivery containers are provided with information on their exterior needed for transport of the container to its destination. This may for example be in the form of address labels, shipping labels and/or customs and other declaration papers. Generating these components has a significant energy footprint.

The use of these applied labels is an obstacle to convenient reuse of a delivery container since they often need to be removed or at least obscured before reuse. Likewise the one-time-use means such as adhesive tape to close the container present an obstacle to its reuse because they typically need to be removed and replaced.

It is known to use an inflatable structure as dunnage. For example, pre-inflated and sealed pillows formed of thin polyethylene film are widely used for this purpose. These are typically used only a single time and their bulk presents an obstacle to them being returned to the sender for reuse.

US20080203090A1 discloses a reusable shipping system comprising a closable shipping container and a packing ensemble disposed in the container's interior which includes an expandable cushioning assembly and a reusable packing accessory. The expandable cushioning assembly is a layered arrangement having at least one foam layer and an inflatable bladder, while the packing accessory may be one or more cushioned bags or the like.

US2007221530A1 discloses a packing box equipped with an airbag for shock-absorbing, in which the airbag consisting of a plurality of air cells is integrally formed with an inner surface of the packing box by means of heat and pressure, instead of installing a separate shock-absorbing member in the packing box, and then air is injected into the airbag. The air cells of the airbag have their own one-way valves, so the shock-absorbing function of the airbag is continuously maintained even if some air cells are broken. Square support bars are integrally formed with a lower surface of the packing box, thereby further absorbing impact applied to the packing box. The product described here is not well suited to reuse nor to recycling due to its construction.

CN215754172 discloses a fragile product packaging box which comprises a box body, a box cover, an inner box, a first spring, an air cushion and a fixing assembly. The box cover is arranged on the box body. A fixed component comprises a movable plate, an elastic telescopic rod, a mounting plate, a screw rod, and a fixed block. The spring and the air cushion are arranged so that the inner box is damped and protected, the impact is absorbed, and the fragile products are prevented from being damaged by an external force. This is an elaborate and complex construction which is not practicable for mass use.

US2019062027A1 discloses a shock-absorbing packing box in which a pair of inner shells are partially fused between a pair of outer shells to constitute a shock-absorbing packing material having a plurality of air cells. When inflated, the air cells are connected in an overall box-shaped structure. This packing box is content-specific and cannot be used for other contents having a different shape and size.

Other examples of containers provided with inflatable dunnage, not all of them well suited to reuse, are provided in US2022250823A1, CN211253673U, DE19548704A1, EP3828102A1, CN202414444U and U.S. Pat. No. 5,339,602A.

A delivery container needs to be straightforward to use, especially for the recipient. One challenge in relation to containers with inflatable dunnage can be that the inflatable dunnage embraces the content so closely as to make its removal difficult, at least without deflation of the dunnage. Another is that pressurised dunnage, suddenly released upon opening of the container, could conceivably cause consternation or even injury if, for example, it causes a container closure to be rapidly opened when it is released.

A practical obstacle to the reuse of delivery containers is their bulk. In order to be reused, the container will often need to be returned to its sender or delivered empty to a fresh point of use. But the volume taken up by the empty container in a vehicle may make this return journey uneconomic, and also represents an environmental burden. Conventional forms of dunnage such as paper and foam are also intrinsically bulky-taking up space in the container is one of their key functions-so their return journey for reuse also has an economic and an environmental cost.

US2012269594A1 discloses inflatable dunnage for use in transport of biocontainers and explains that the inflatable dunnage can be returned to the sender for reuse economically because it deflates and collapses into a small space. This document also suggests use of the inflatable dunnage in a collapsible rigid outer container, without giving details of how the container is able to collapse.

US2017320650A1 discloses a resuable delivery container with inflatable dunnage, the container having flexible walls formed of hemp, cotton or denim assembled by stitching. An airflow network comprising plastic or rubber tubing extends along vertices of the erected container and provides impact and structural support when the container is in its expanded configuration. It is questionable how much protection a container of this type, whose structure relies on inflatable tubes, is able to give, bearing in mind the rough treatment that can be given to containers in transit.

CN108128519A concerns a foldable packaging box provided with an inflatable airbag. Panels forming the box structure are joined to one another along certain vertices through some form of hinge, while to enable the structure to collapse other vertices are formed by zippers, so that erecting and collapsing the box involves zipping/unzipping these connections. Ease of use, and robustness, of this packaging box may be questioned.

Problems remain in providing a collapsible container with inflatable internal dunnage which is adequately robust whilst being convenient to collapse and stow for delivery.

One such problem is that if the inflatable dunnage is to remain in the collapsed container then it needs to be folded into a small volume. To this end, it is desirable that the dunnage should tend to fold tidily as the container collapses. If the dunnage crumples haphazardly it may prevent collapsing of the container. The airbags and tube arrangements found in the prior art do not appear to be configured to fold tidily.

A convenient means of maintaining the container in its collapsed state is also desirable, since otherwise the container may inadvertently be wholly or partly erected during handling.

OBJECTS OF THE PRESENT DISCLOSURE

There is a need to overcome the drawbacks, limitations, and shortcomings associated with existing containers, and to provide an improved reusable container capable of protecting its content from physical damage.

It is an object to provide an improved reusable cushioned container that can be used multiple times in a sustainable manner.

An additional or alternative object is to provide a cushioned container that is easily collapsible, making it easy to store or transport when empty.

An additional or alternative object of the present invention is to provide a collapsible container with internal inflatable cushioning which is able to fold tidily as the container is collapsed, thereby to minimize its bulk.

An additional or alternative object is to provide a cushioned container which can be easily and safely opened for removal of the container's contents.

An additional or alternative object is to provide a cushioned container which is able to be stored and transported when empty while taking up a volume smaller than that taken up by the full container.

An additional or alternative object is to provide a cushioned container capable of storing and displaying information about its contents without need of adhered labels or other physical markings.

SUMMARY OF INVENTION

According to a first aspect of the present invention there is a container comprising:

a container body which forms an internal cavity for receiving content and has an opening through which the content is able to be inserted to and removed from the internal volume;

a closure which is movable with respect to the container body between a closed position in which it closes the opening and an open position in which the opening is uncovered;

a locking member which is movable between a lock position and an unlock position and which is configured when in the lock position to lock the closure in its closed position, the locking member being configured to release the closure when moved to the unlock position to enable the closure to be moved to its open position;

inflatable dunnage disposed in the internal volume and configured to be inflated by injection of gas or liquid;

an exhaust port communicating with the inflatable dunnage; and an exhaust port shutoff arrangement having a closed state in which it closes the exhaust port and an open state in which it opens the exhaust port;

wherein the locking member is configured to cooperate with the exhaust port shutoff arrangement such that moving the locking member from its lock position to its unlock position causes the exhaust port shutoff arrangement to change from its closed state to its open state, whereby pressure in the inflatable dunnage is automatically released through the exhaust port prior to opening of the container.

The closure may take the form of a lid and may be hingedly couped to the remainder of the container body. The locking member may be rotatably coupled to the container body or to the closure/lid.

In an embodiment, the exhaust port shutoff arrangement comprises a bung carried on the locking member and arranged to be inserted into the exhaust port by the action of moving the locking member to its lock position, and to be withdrawn from the exhaust port by the action of moving the locking member to its unlock position.

To provide for inflation of the inflatable dunnage, the bung may incorporate an inflation port through which the inflatable dunnage is able to be inflated whilst the bung is in the exhaust port. The inflation port may comprise a passage through the bung configured to receive a needle-type inflation nozzle and to seal resiliently when the nozzle is withdrawn. Alternatively the inflation port may be formed separately from the bung. The inflation port may be provided with a one-way valve to admit gas/fluid to the inflatable dunnage but prevent its escape through the inflation port.

In an embodiment, the exhaust port shutoff arrangement comprises a rotary-action valve coupled to the locking member such that rotary movement of the locking member opens and closes the rotary action valve. The rotary-action valve may lie on an axis of rotation of the locking member, which may be substantially perpendicular to a panel of the container body carrying the locking member.

The container may be collapsible, whereby its volume is able to be reduced for storage and/or for delivery when empty. Whereas cardboard boxes, for example, are collapsible once after use, the present container is preferably configured to be reconfigurable between a collapsed state and a use state repeatedly and reversibly. The container preferably comprises one or more locking arrangements to lock it releasably in the use state. The container preferably comprises one or more locking arrangements to lock it releasably in the collapsed state.

In an embodiment, the container body comprises a top panel, a bottom panel and a plurality of collapsible side walls connecting the top panel to the bottom panel so that the container is able to be repeatedly and reversibly reconfigured between a use state and a collapsed state, the side walls being upright in the use state so that the internal volume is defined between the top panel, the bottom panel and the side walls, and the side walls being collapsed in the collapsed state to move the top panel toward the bottom panel.

In an embodiment, the container is provided at its exterior with a rewritable electronic display. This is able to display a destination address and other information needed in relation to delivery, obviating the requirement for gummed labels or written markings on the container which might need to be removed or erased prior to reuse. The electronic display may be part of a display module configured to communicate with a computing device via a secure communication channel through which information to be displayed is transmissible to the display module.

Other embodiments of the invention make it possible to minimise volume taken up by the empty container by enabling its components to be disassembled and stacked with each other and/or with similar components of further containers. In one such embodiment, the container body comprises at least two separable parts which, when assembled to one another, define the internal volume, and at least one of which is configured to enable it to be stacked with other identically-formed parts one within another. The separable parts may comprise a base panel with upstanding peripheral walls which diverge from one another in a direction away from the base panel.

The interior cavity of the container may be divided into two or more separate spaces by an inflatable structure serving both as dunnage and as a divider. When deflated, this structure is able to collapse along with the rest of the container.

According to a second aspect of the present invention, there is a container comprising inflatable dunnage and a container body comprising: a top panel, a bottom panel, a plurality of collapsible side walls connecting the top panel to the bottom panel and an opening, so that the container is able to be repeatedly and reversibly reconfigured between a use state and a collapsed state, the side walls being upright in the use state so that an internal cavity is defined between the top panel, the bottom panel and the side walls into which content is insertable through the opening, and the side walls being collapsed in the collapsed state to move the top panel toward the bottom panel thereby reducing volume of the container.

The inflatable dunnage may comprise back-to-back sheets of flexible impermeable material selectively seamed to form inflatable cells. It may remain in the container as the container is collapsed, ready for reuse.

If the dunnage were to crumple in a disorderly fashion during collapsing of the container, it might create a local bulk which would resist the collapse. In an embodiment, the inflatable dunnage is disposed inside the container body and is secured or tethered to the container body such as to fold along with it.

The collapsible side walls may in some embodiments leave openings within or between themselves when upright. In an embodiment, such openings are covered by at least one flexible panel able to fold as the side walls are collapsed. The flexible panel may comprise textile material. It may form a continuous band around the side walls, or it may be applied locally. It may be disposed within the container body, or it may be disposed outside it.

In one suitable collapsible container structure, in accordance with an embodiment of the invention, each of the side walls comprises an upper panel and a lower panel, the upper panel having an upper edge which is hingedly connected to the top panel and a lower edge which is hingedly connected to an upper edge of the lower panel, the lower panel having a lower edge which is hingedly connected to the bottom panel, and each of the upper and lower panels has a trapezoidal shape so that the upper panels can be turned inward to lie in a common plane without fouling one another, and the lower panels can be folded inward to lie in a common plane without fouling one another.

Resultant openings in the side wall structure may be covered by means of a tubular skirt which surrounds the side walls, being connected about its upper periphery to the top panel and about its lower periphery to the bottom panel. The skirt is preferably selectively tethered to the container body such as to crease in an orderly fashion as the container body collapses.

In an embodiment, the container is provided with a user-operable and releasable mechanism for locking the container in the collapsed state.

In an embodiment, the container body further comprises a closure movable between a closed position in which it closes the opening to prevent access to the internal cavity and an open position in which the opening is uncovered, the container further comprising a locking member mounted to the container body and movable relative to it between a lock position and an unlock position, wherein (a) with the closure in its closed position the locking member is configured to lock the closure in the closed position while in the lock position, and to release the closure when in the unlock position; and (b) with the container in its collapsed state, the locking member is configured to lock the container in the collapsed state when in its lock position and to release the container and enable to it be reconfigured to its use state when in the unlock position.

In an embodiment of the present invention, a pressurized canister filled with fluid is connectable to the inflatable dunnage. The pressurized canister may be easily accessible to a user, enabling the user to adjust pressure within the inflatable dunnage even when the container is sealed for transportation. The pressurized canister may help maintain the required pressure within the inflatable pillows from the packaging stage up to the destination, thereby protecting the stored objects from damage in the event of loss of pressure within the inflatable dunnage.

The container according to the present invention can be reusable and hence environmentally sustainable. Its inflatable dunnage provides shock absorption and protection for the container's content. The inflated dunnage adopts a shape complementary to a vacant space around the content within the container, surrounding the content and protecting it from impact. Conventional disposable dunnage can be dispensed with entirely.

Various objects, features, aspects, and advantages of the inventive subject matter will become more apparent from the following detailed description of preferred embodiments, along with the accompanying drawing figures in which like numerals represent like components.

BRIEF DESCRIPTION OF DRAWINGS

Specific embodiments of the present invention will now be described, by way of example only and not of limitation, with reference to the accompanying drawings, in which:—

In FIG. 25 the container is assembled for use. In FIG. 27 it is disassembled and in FIG. 26 it is disassembled and stacked;

DETAILED DESCRIPTION

Figure 1:
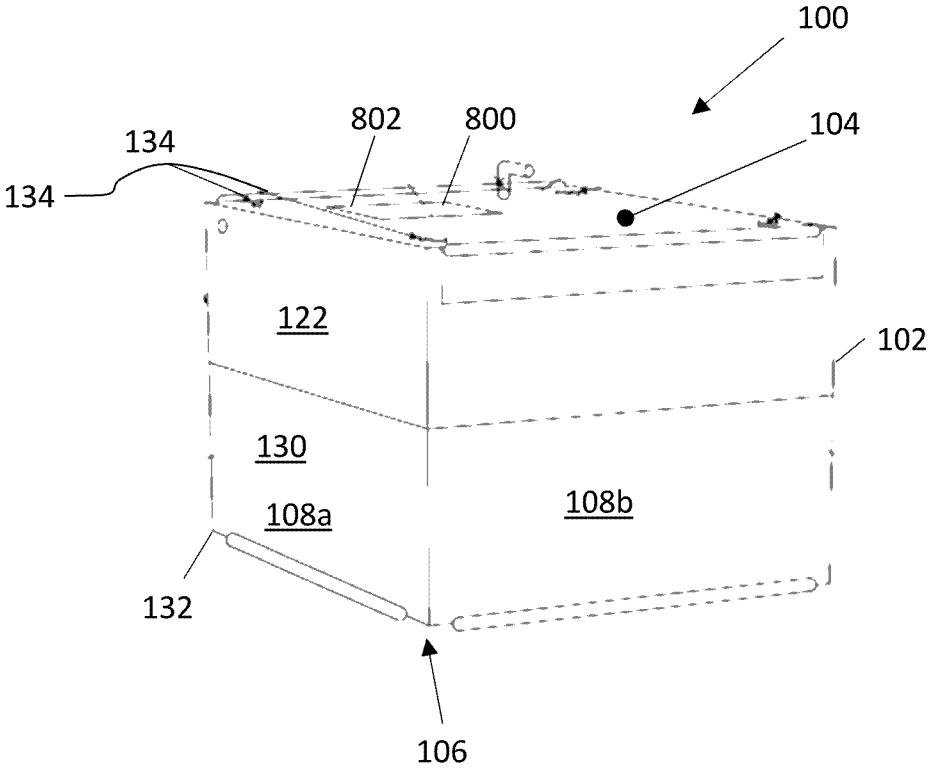
FIG. 1 depicts a container embodying the present invention, viewed from above and to one side.
Figure 2:
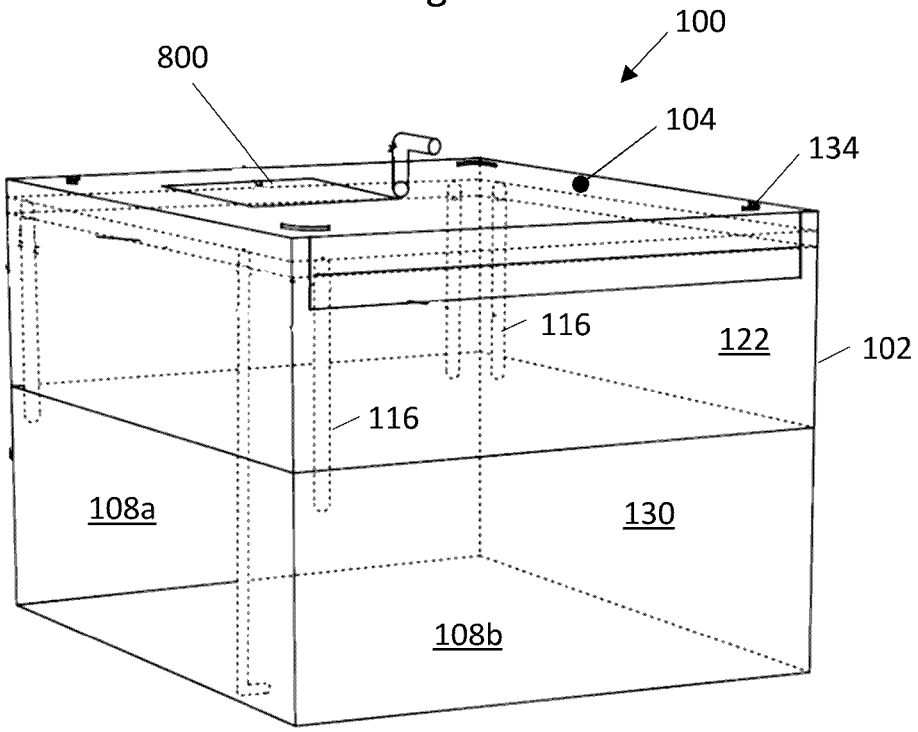
FIG. 2 corresponds to FIG. 2 but includes features within the container, represented in phantom.
Figure 3:
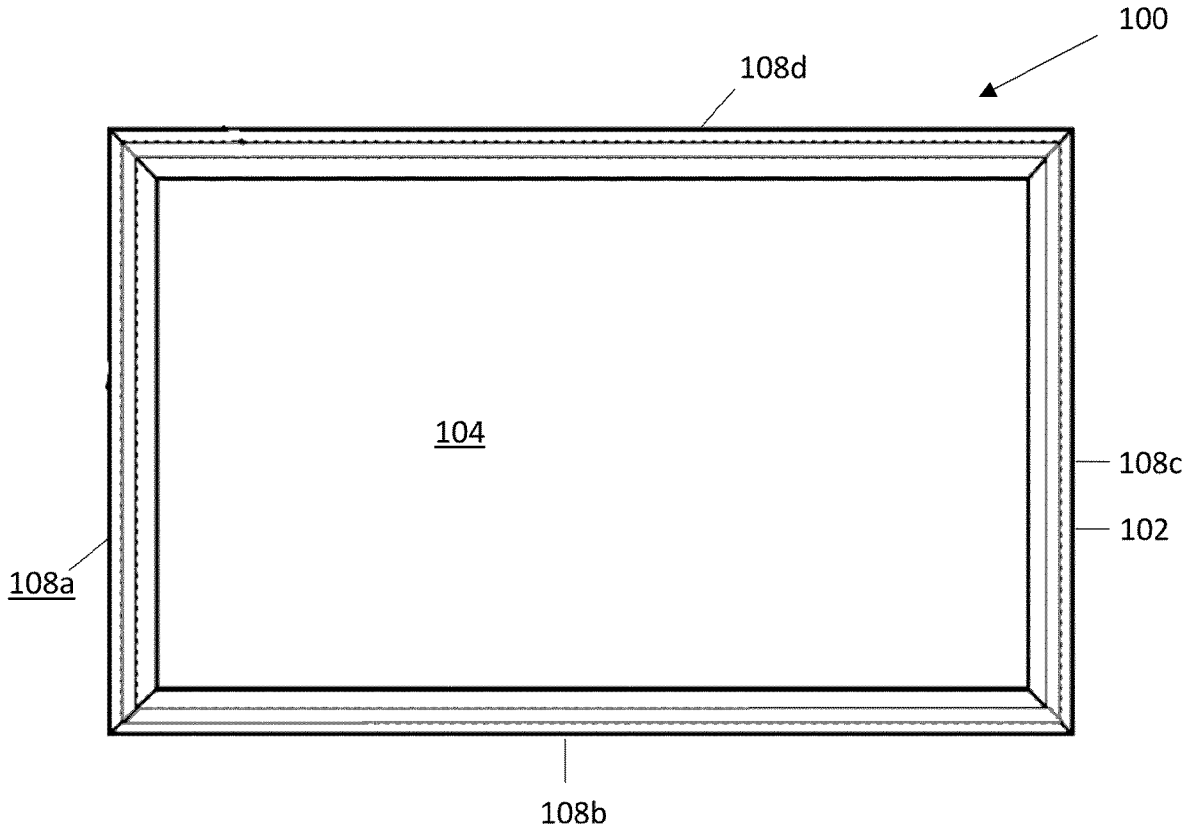
FIG. 3 is a plan view of the container of FIG. 1.
Figure 4:
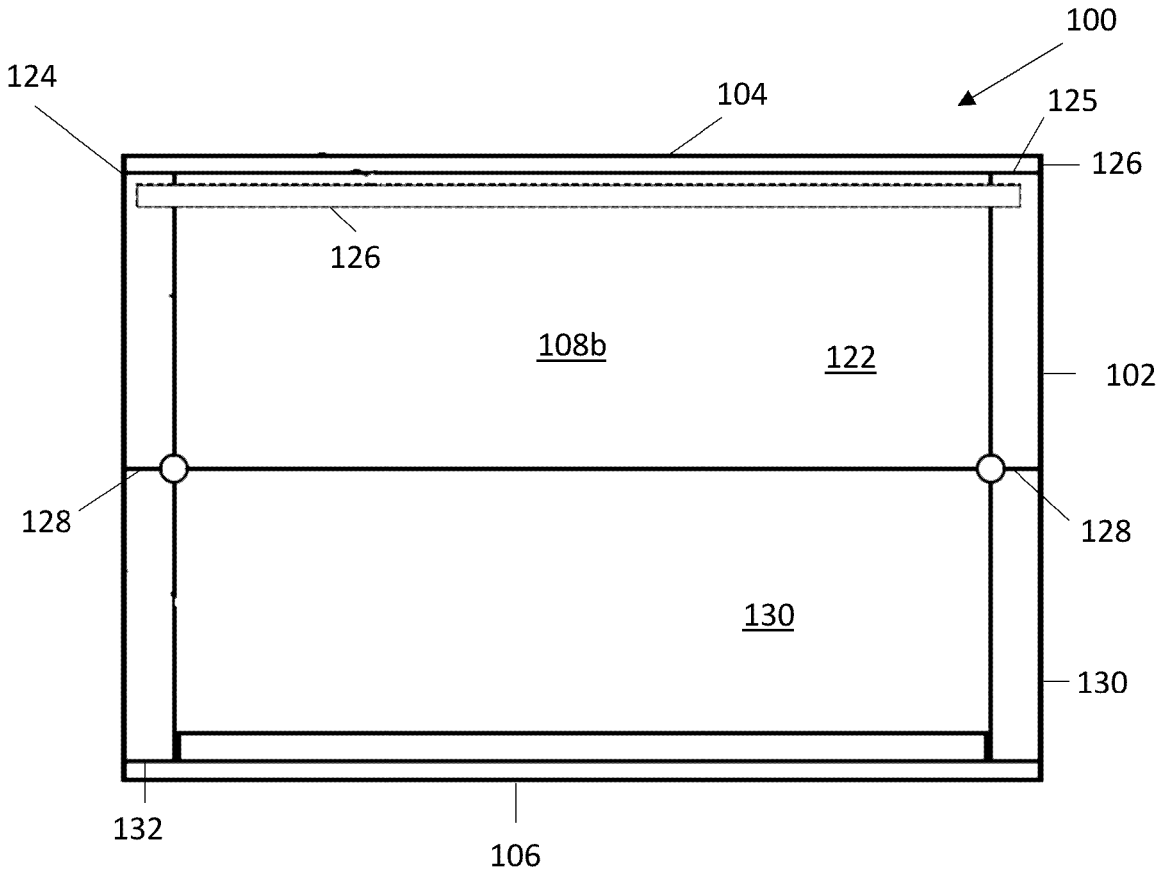
FIG. 4 is a side elevation of the container of Figure.

The following is a detailed description of embodiments of the embodiments depicted in the accompanying drawings. The embodiments are presented by way of example and not of limitation. The detail offered is not intended to limit the scope of the invention; on the contrary, the intention is to cover all modifications, equivalents, and alternatives falling within the scope of the present invention according to the appended claims.

Referring to FIGS. 1 to 7, a container 100 comprises a container body 102 in the form of a box having a closure in the form of a lid 104, a bottom panel 106 and multiple side panels 108. The panels 106, 108 and the lid 104 together define the container's shape, which in this example is cuboidal although other container shapes may be adopted in other embodiments. The lid 104 is movable between a closed position in which it covers an otherwise upwardly open face of the container body 102, preventing access to the interior of the container 100, and an open position in which the said upwardly open face is exposed. The lid 104 may in some embodiments be wholly removable from the container body 102 but in the present embodiment is hingedly connected to the container body 102. With the lid in its open position the container 100 can receive content 112 through its open face. Any suitably-sized object or item may form the content. The lid 104 may be securable in its closed position through a suitable locking arrangement. This is not depicted in FIGS. 1 to 7 but suitable locking arrangements will be described below and may be used with the container 100.

The container 100 may comprise two or more compartments within the container body 102 to facilitate accommodation of individual items of content 112 in respective compartments. One or more removable partitions can be placed within the container 100 to form the compartments. The partitions may be inflatable.

The container 100 further comprises inflatable dunnage, formed in the present embodiment by one or more inflatable pillows 114 within the container body 102. The pillows 114 are able to to be inflated and deflated from outside of the container 100. The pillows 114 may be inflated before the content 112 is placed in the container 100. Alternatively, the content 112 may be placed in the container 100 with the pillows 114 deflated, and the pillows 114 may then be inflated to take up the vacant space around the content 112 and to closely embrace it. In either case, the content 112 may be surrounded, embraced and protected by the pillows 114 as depicted in FIG. 5.

In the present embodiment the pillows 114 are in fluid communication with one another through conduits 116 in the form of pipes, which may be flexible. Gas to inflate the pillows 114 is supplied from a gas source 118 which may for example comprise a pump or a pressurised gas reservoir. A gas extractor may in some examples be used to draw gas out of the pillows 114 to fully deflate them. While the pillows 114 of the present embodiment are to be gas filled, they may instead be filled with liquid in other embodiments.

Figure 5:
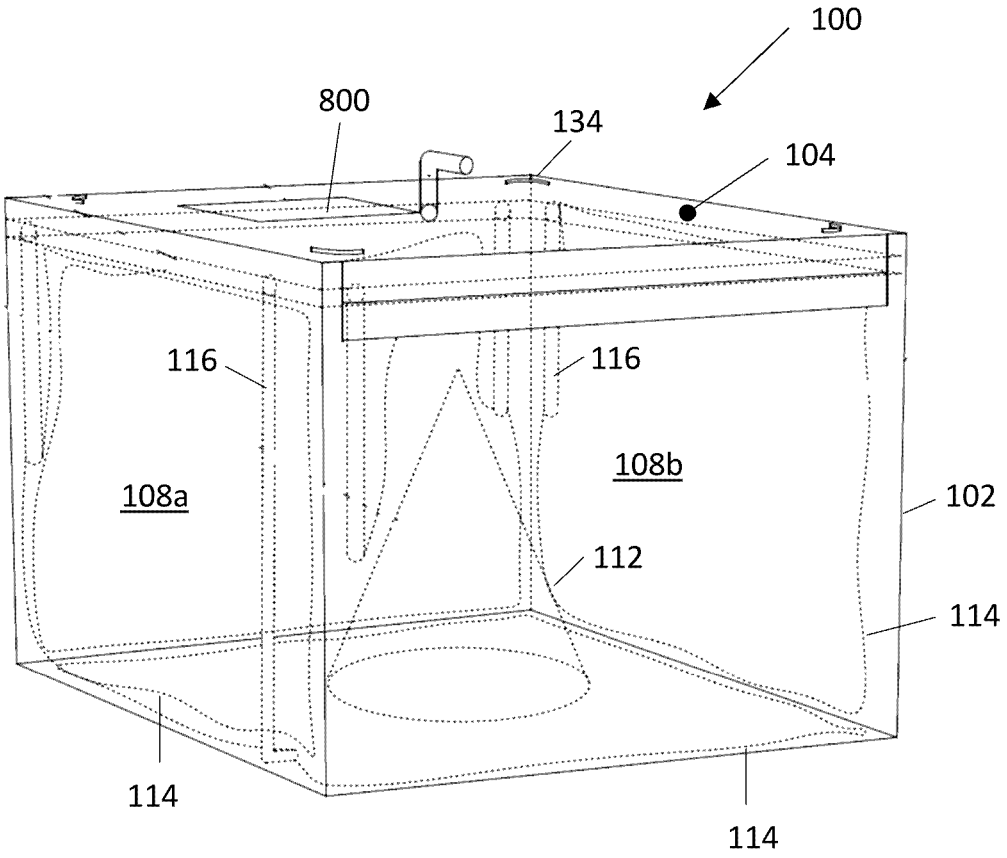
FIG. 5 is a further view of the container of FIG. 1 including content.
Figure 6:
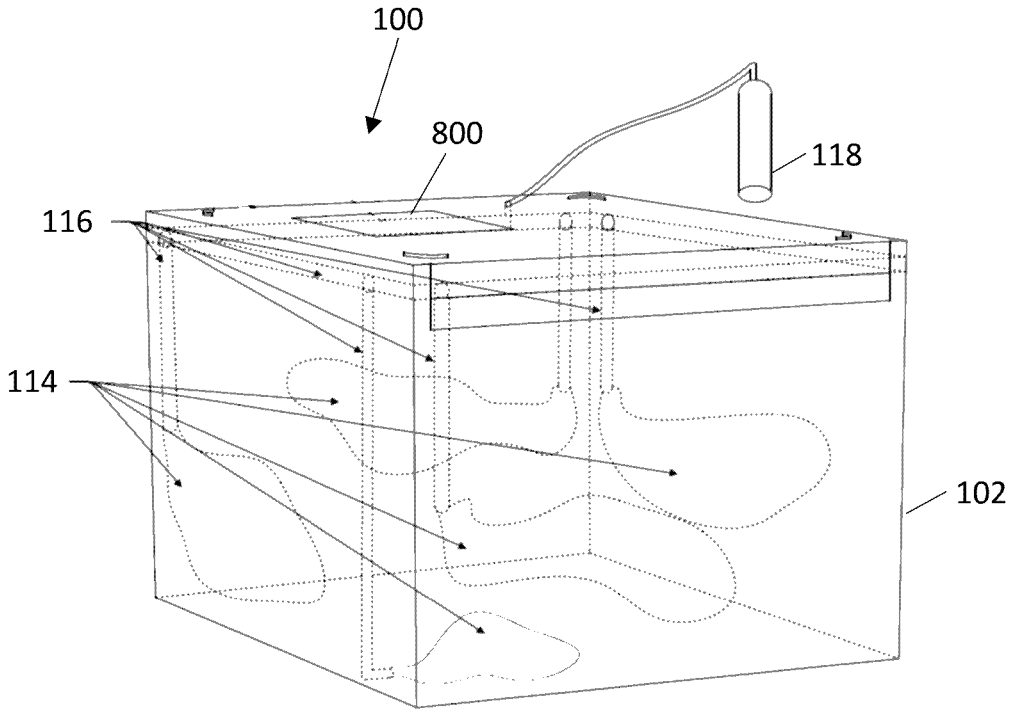
FIG. 6 is a further view of the container of FIG. 1 in which internal inflatable dunnage is shown partly inflated.

As shown in FIG. 5, each internal face of the container body 102 is in this embodiment provided with a respective pillow 114 to surround the content 112 from all sides.

FIG. 5 depicts, purely by way of example, a conically shaped item of content 112 and balloon-shaped inflatable pillows 114, but the invention imposes no limitation on the nature or shape of the content 112. The shapes of the inflatable pillows 114 may also differ in other embodiments, and may be chosen to accommodate content of a particular shape.

The container 100 may, without limitation, comprise any of plastic, cardboard, metal, wood, or biodegradable material. The inflatable pillows 114 may be made of a flexible, fluid-impermeable material. A suitable material is known as TPU-coated fabric and comprises a textile sheet with a thermoplastic polyurethane coating. The textile sheet can be robust and tear resistant. The coating renders the material impermeable to gases.

One of the challenges to reuse of delivery containers is that their bulk makes them cumbersome to ship and to store when empty. For example, where containers are used for delivery of retail items to consumers, the containers will typically need to be returned to a depot for refilling if they are to be reused. But empty containers potentially take up a large volume in a delivery vehicle, so the cost of this return journey can be an economic obstacle to reuse of the containers. Warehousing a large number of bulky containers can also be uneconomic. To address this problem, containers embodying the present invention may (a) be collapsible or (b) be configured to stack one within another. In either case, the use of inflatable dunnage is advantageous because when deflated its volume too can be minimized. After a delivery, the dunnage is deflated, the container is collapsed and/or placed in a compact stack with other similar containers, and in this straightforward manner the volume taken up by the container is minimized.

The container 100 is collapsible. In the embodiments depicted in FIGS. 1 to 7, each of the side panels 108*a-d* of the container body 102 comprises an upper subpanel 122 having an upper edge 125 hingedly connected to an edge of an upper panel 126 of the container body 102, and a lower edge 128 hingedly connected to an upper edge of a lower sub-panel 130. Lower edge 132 of the lower subpanel 130 is hingedly connected to an edge of the bottom panel 106. This configuration allows the container 100 to be switched between a collapsed state and an in-use state.

Figure 7A:
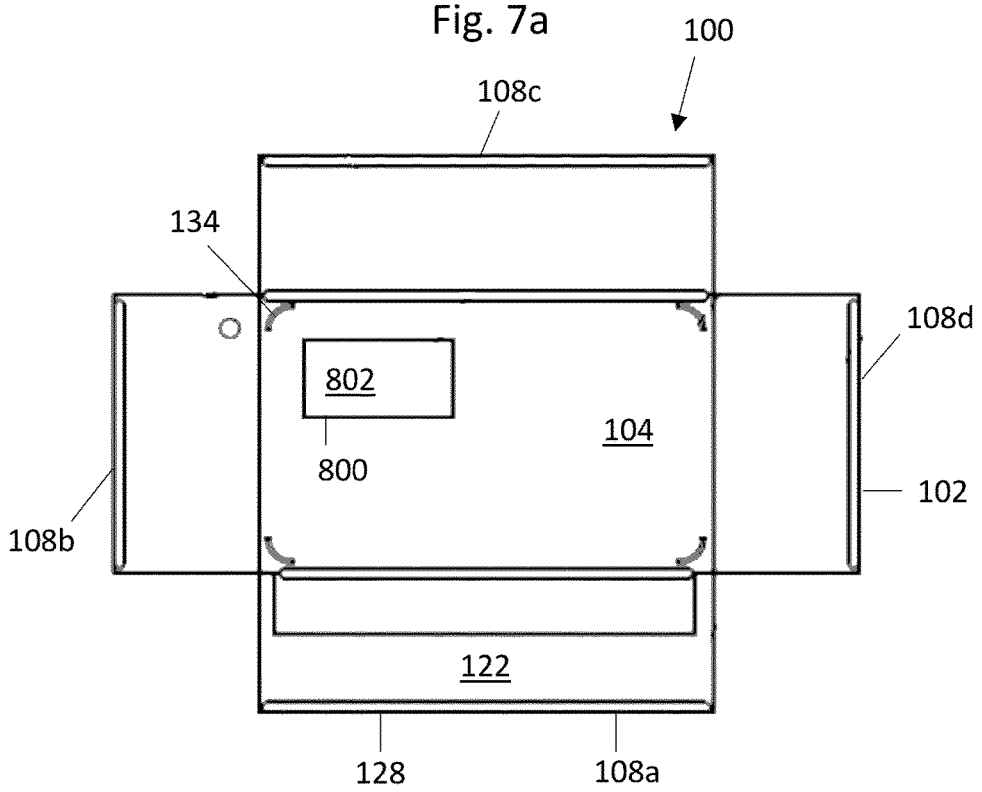
FIGS. 7*a*, 7*b* and 7*c* depict the container of FIG. 1 in a collapsed state and in plan, side elevation and end elevation respectively.
Figure 7B:
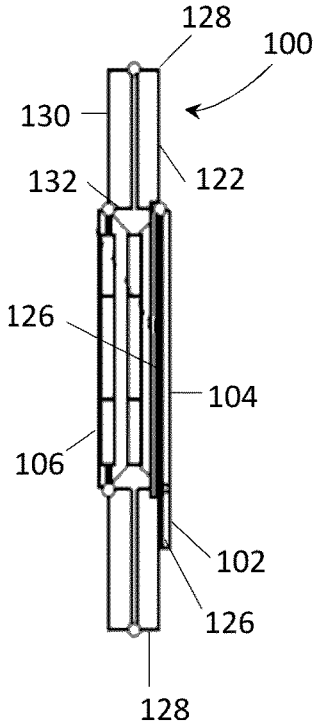
Figure 7C:
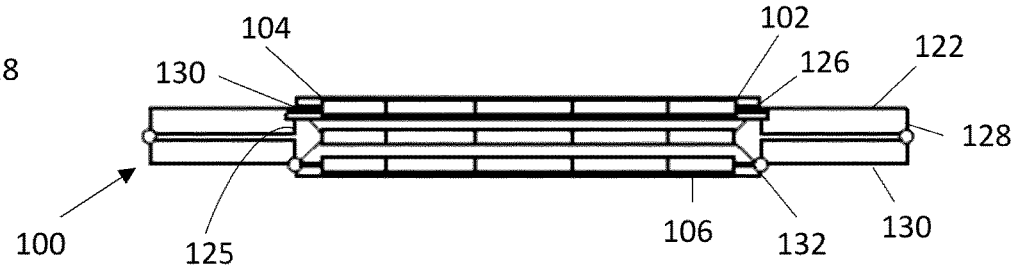

In the collapsed state, depicted in FIG. 7, the upper and lower subpanels 122 and 130 are turned outwardly to lie face to face with one another and generally parallel with the bottom panel 106. The upper panel 126 lies adjacent the bottom panel 106, providing a configuration of small depth which thus takes up a small volume. The deflated pillows 114 and pipes 116 are securely accommodated between the panels 106, 126.

The container body 102 is converted from the collapsed state to the use state by drawing the upper panel 126 away from the lower panel 106, causing the upper and lower subpanels 122, 130 to turn and so take up positions in which they lie in a common plane and largely perpendicular to the bottom panel 106, maximizing the separation of the bottom panel 106 from the upper panel 126 and forming the erect container's cuboidal shape, ready to receive the content 112.

The reconfiguration between the collapsed and use states is reversible and can be carried out repeatedly.

The containers 100 are configured to be stacked one upon another both in the collapsed state and in the use state, and may be provided with registration features to maintain alignment of neighbouring units in a stack, thereby facilitating orderly stacking and/or enhancing stability of the stack. The registration features may be provided on top and/or bottom faces of the container 100. In the present embodiment the registration features comprise ridges 134 at corners of the lid 104.

FIGS. 8 to 13 depict a second container 200 which embodies the present invention. It shares various constructional features with the first container 100. Container body 202 of container 200 comprises a bottom panel 206, side panels 208 each comprising an upper subpanel 222 and a lower subpanel 230, a closure in the form of a lid 204, and an upper panel 226 immediately beneath the lid 204. The container 200 has a rectangular plan shape and hence has four side panels 208, although other shapes may be used in other embodiments. The upper subpanels 222 are each hingedly coupled at their upper edges 224 to a respective edge of the upper panel 226 and are each hingedly connected at their lower edges 228 to a respective lower subpanel 230, Each lower subpanel is hingedly connected at its lower edge 232 to a respective edge of the bottom panel 206.

Figure 13:
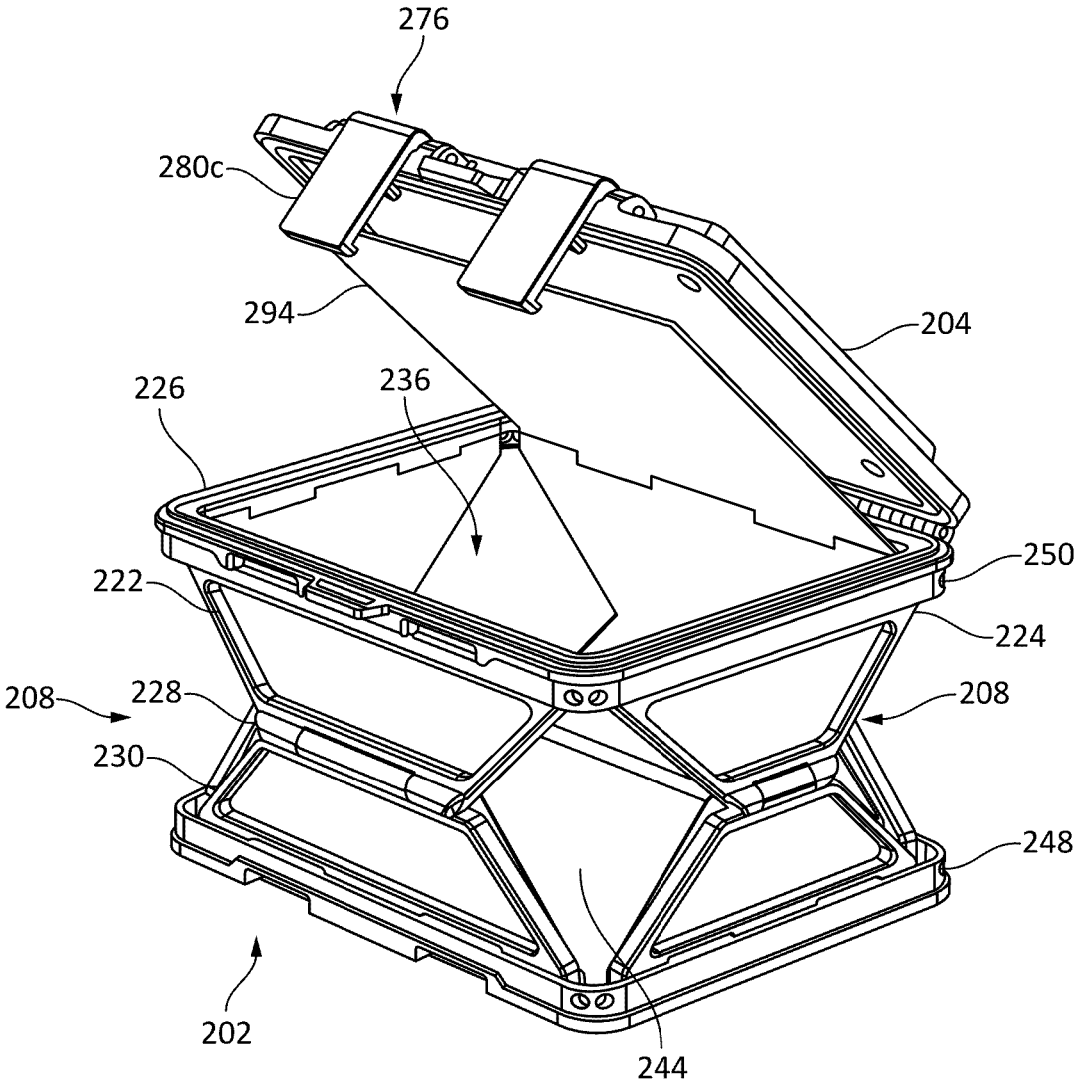
FIG. 13 depicts the container body of FIGS. 8 to 10 with a lid open, the external skirt once more being omitted.

The lid 204 is hinged to the upper panel 226 and is seen in its open position in FIG. 13, which also shows opening 236 in the upper panel 226, through which content 112 is able to be placed in, and removed from, the container 200.

Figure 8:
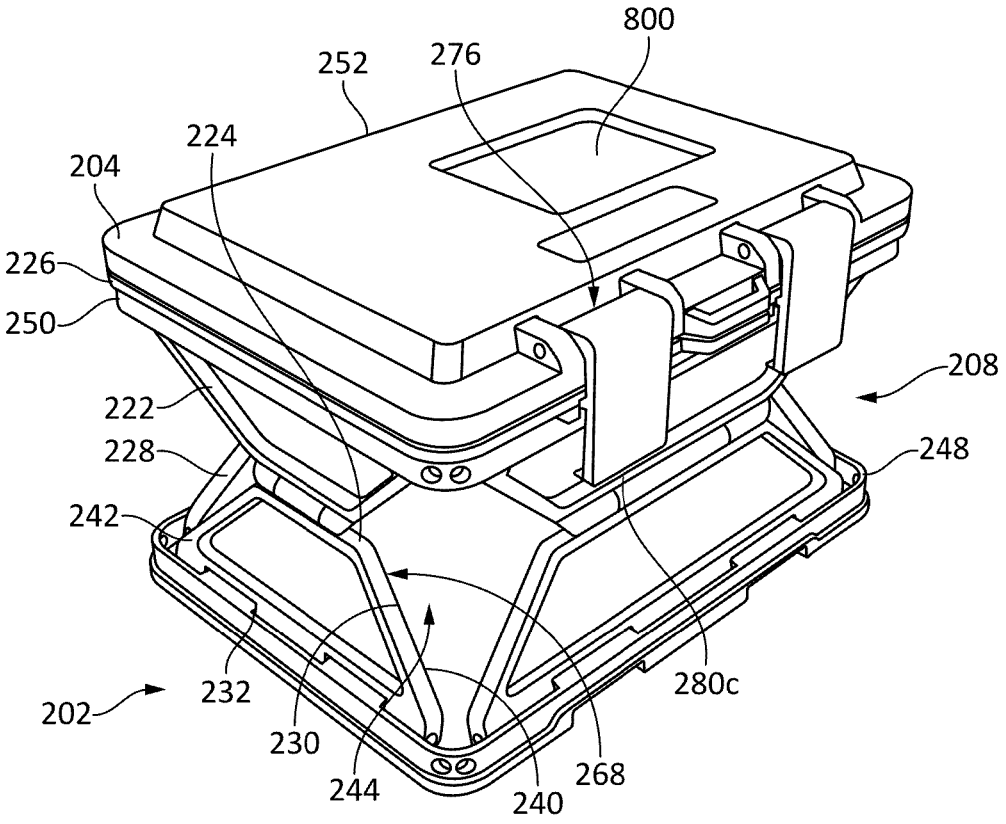
FIG. 8 depicts a container body of a further container embodying the present invention, an external skirt being omitted from the drawing to reveal internal detail.
Figure 9:
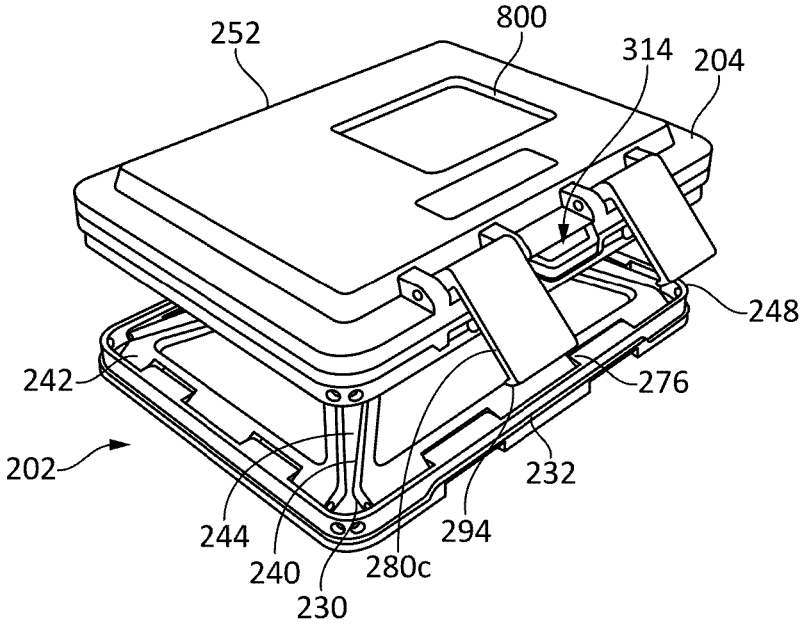
FIG. 9 is similar to FIG. 8 but depicts the container body in a partly collapsed state.
Figure 10:
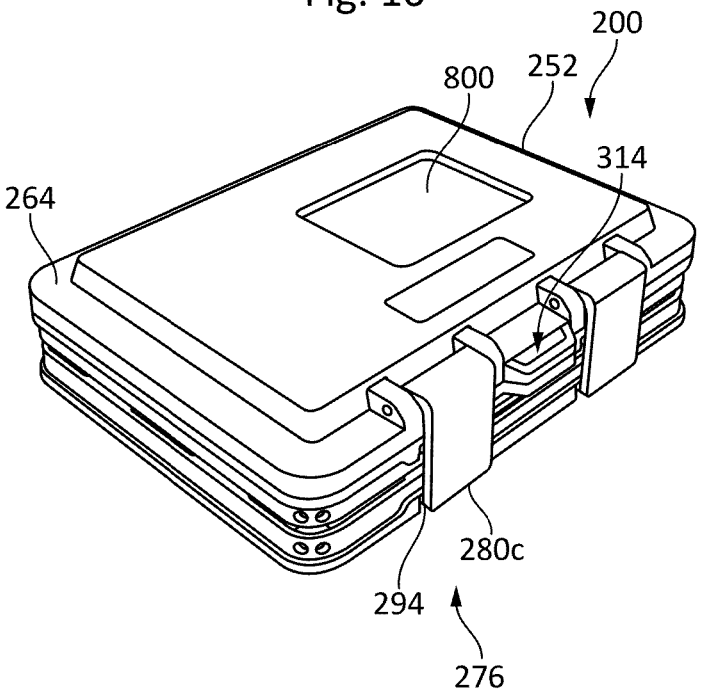
FIG. 10 is similar to FIG. 8 but depicts the container body in a fully collapsed state.
Figure 11:
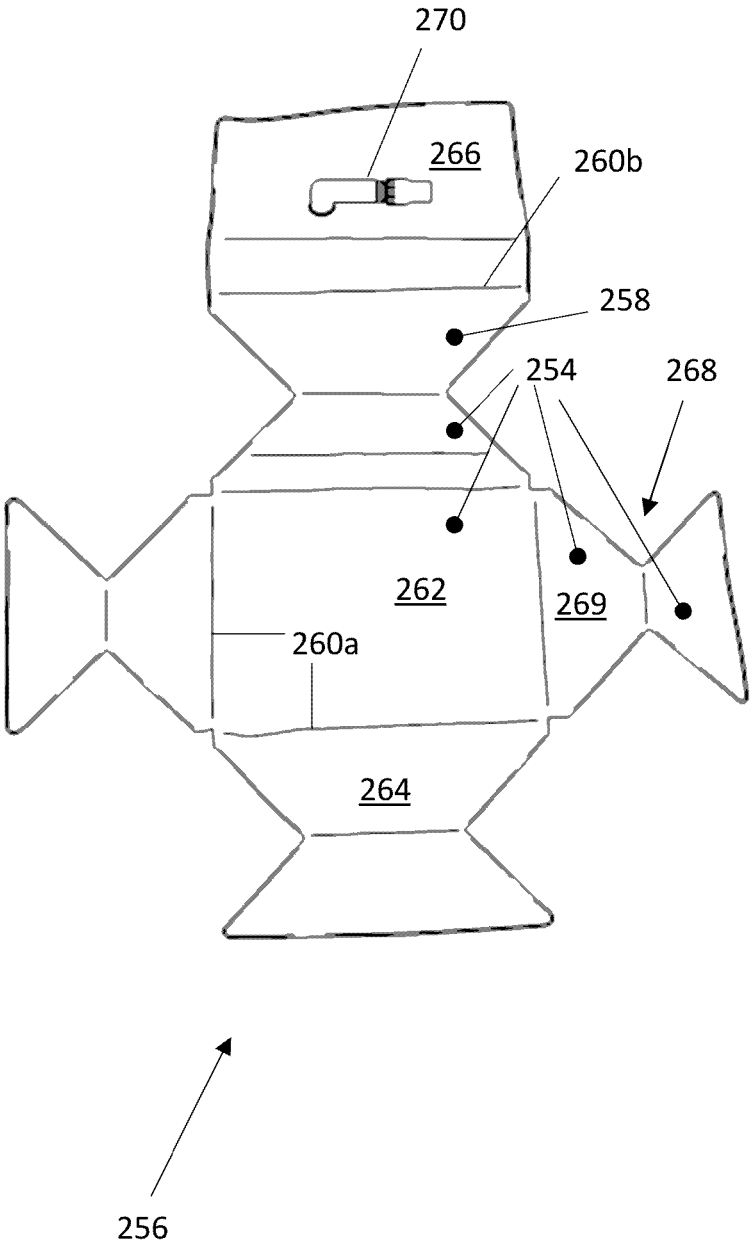
FIG. 11 depicts, in plan, inflatable dunnage for use in the container body of FIGS. 8 to 10.

The second container 200 is able to be reversibly and repeatedly reconfigured between the collapsed state of FIG. 10 and the use state of FIG. 8. The second container 200 differs from the first container 100 in that to collapse the container body 202, its upper and lower subpanels 222, 230 turn inwards (rather than outwards) to lie within the footprint defined by the bottom and the upper panels 206, 226, as can be appreciated from FIGS. 9 and 10. In this way the footprint of the collapsed container 200 is minimized and the collapsed container forms a roughly cuboidal shape which is easy to handle and to stack. To permit the subpanels 222, 230 to turn inwards without fouling each other, each of the subpanels 222, 230 has ends 240, 242 which are not perpendicular to the upper and lower edges 224, 232, but are instead inclined to them to form a trapezoid shape (more specifically an isosceles trapezoid shape, in the present example) which converges in the direction toward the hinged connection between the upper subpanel 222 and the lower subpanel 230. The lower subpanel 230 is wider at its lower edge than at its upper edge, while the upper subpanel 222 is wider at its upper edge than at its lower edge. In the present example, the ends 240, 242 are angled at substantially 45 degrees to the upper and lower edges 224, 232. Consequently the lower subpanels 230 can turn inwards to lie in a common plane with their ends 240 neighbouring but not fouling one another, and likewise the upper subpanels 222 can turn inwards to lie in a common plane without fouling.

A locking mechanism is provided to maintain the upper and lower subpanels 222, 230 in the upright orientations of FIG. 8, and so maintain the container 200 in the use state. The side panels 208 provide the container 200 with columnar strength which is important when filled containers are stacked.

Figure 12:
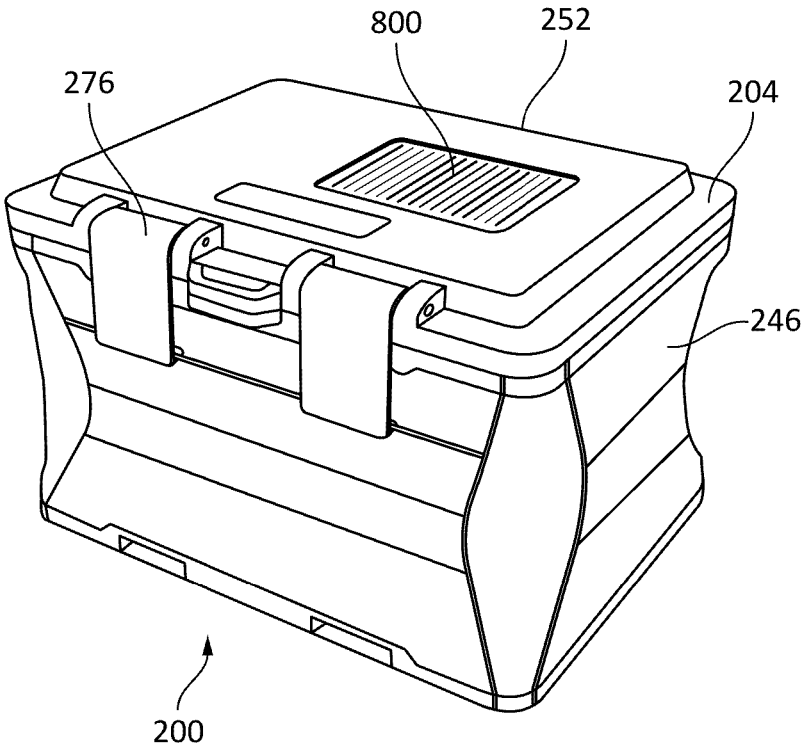
FIG. 12 depicts the container of FIGS. 8 to 11 and includes the external skirt.

The trapezoidal subpanels 222, 230 do not form a continuous wall for the container body 202 in its use state since their angled ends 240, 242 leave spaces 244 between them at the container's upright vertices. To provide an enclosed space to receive the content 112, the container 200 further comprises a flexible skirt 246 which extends from the bottom panel 206 to the upper panel 226 and which is disposed around and outside the side panels 108, as seen in FIG. 12. The skirt 246 comprises flexible sheet material. In the present embodiment it comprises a textile, but other forms of flexible membranous material such as plastics or rubber sheet may be adopted. The bottom panel 206 is seen in FIG. 8 to have a peripheral upstand 248 and the upper panel 226 likewise has a peripheral upstand 250. Bottom and top edges of the skirt 246 are secured to the respective upstands, e.g. by bonding, to keep the skirt 246 in position.

It is desirable that the skirt 246 should fold tidily as the container 200 is collapsed, avoiding crumpling which might resist the movement of the upper panel 226 toward the bottom panel 206. To this end, the skirt 246 is tethered to the container body 202 in selected regions, causing the skirt 246 to be drawn inwards along with the subpanels 222, 230 and enabling it to fold tidily. The skirt 246 may for example be secured to the hinge line 228 along the lower edge of the upper subpanel 222. Alternatively it may be adhered or otherwise attached to the outer faces of the subpanels 222, 230. The skirt 246 may comprise pre-formed crease lines causing it to fold tidily at the container's vertices.

As noted above it is desirable for the container 200, when placed in a stack with other similar containers, to register with the neighbouring containers such as to maintain their alignment and facilitate orderly stacking. In the present embodiment the lid 204 is provided with a registration feature in the form of a raised region 252, which is rectangular in plan in this embodiment although other shapes would be suitable. The bottom 206 has on its underside (not shown in the drawings) a complementary recess to receive and register with the raised region 252 of another container 200, thereby to align one with the other in a stack.

The container 200 comprises inflatable dunnage 256 to cushion and/or to locate content 112 within the container 200. In the present embodiment the inflatable dunnage comprises two layers of a flexible skin 258 (see FIG. 12 in particular, although only one of the skins 258 is visible, since it overlies and covers the other). The material of the skin may comprise TPU-coated textile, or it may comprise any other suitable membranous flexible gas-impermeable material. Inflatable cells 254 are formed between the skins 258 by seams 260 which connect one to the other along chosen lines. Gaps in the seams allow for passage of fluid (gas or in some embodiments liquid) from one inflatable cell 254 to another, so that all cells are able to be inflated through a single port 270. The seams 260 may for example be formed by heat welding, adhesion, or any other suitable technique. This two-skinned form of construction is well suited to mass manufacture and can be both economical and physically robust.

At least some of the seams 260 define lines along which the inflatable dunnage 256 is to be creased when it is inside the container body 202. Any creases across the inflatable cells 254 tend to straighten as they expand under internal pressure, but the seams 260 can remain flexible. Viewed in plan as in FIG. 12, the dunnage 256 forms a geometric net able to be folded along some of the seams 260 into a shape which approximately matches the interior shape of the container body 202, and which covers its interior faces. A bottom dunnage panel 262 conforming to the bottom panel 106 of the container body 102 is defined by seams 260*a* and hingedly coupled through them to side dunnage panels 264 which are to be folded upwardly to lie against the side panels 108 of the container body 202. One of the side panels meets a top dunnage panel 266 in a seam 260*b*. The top dunnage panel lies adjacent and beneath the lid 104 in the assembled container 200. The side dunnage panels 264 have V-shaped cutaways 268 to conform to the inclined ends 240, 242 of the subpanels 222, 230 of the container body 202. Consequently the side dunnage panels 264 are able to fold tidily as the container 200 collapses, without excess material at the upright vertices of the container 100 which might crumple and so form a bulk which would resist the collapsing action.

Tidy folding of the inflatable dunnage 256 during collapsing of the container 200 may also be promoted by tethering the inflatable dunnage 256 to the container body 202. Tethers may be provided only at chosen lines or points. For example, tethers may be provided at chosen vertices in the structure of the container body 202. Alternatively, the inflatable dunnage 256 may be adhered or otherwise secured to internal faces of the container body 202, to move along with them.

The container 200 comprises a locking arrangement 276 which is able to serve more than one function. It is used to selectively mechanically lock the lid 204 in its closed position, preventing inadvertent release of (and in some cases unauthorized access to) content 112. And it cooperates with an exhaust port shutoff arrangement 278 (see FIG. 14) to automatically exhaust pressure from the inflatable dunnage 256 when the lid 204 is unlocked. In some embodiments the locking arrangement 276 has a third function which is to maintain the container 200 in its collapsed state.

The automatic deflation of the inflatable dunnage 256 upon opening of the container 200 has various advantages. If the content 112 is tightly embraced by the dunnage when inflated, a recipient of the container 200 might struggle to withdraw the content 112 without first deflating the dunnage and might even damage the dunnage in such attempts. Also the inflated dunnage might, were its pressure not released, cause the lid 204 to fly open on being unlocked, causing possible consternation or even risk of injury. Both risks are mitigated by the automatic release of pressure from the inflatable dunnage 256.

Figure 14:
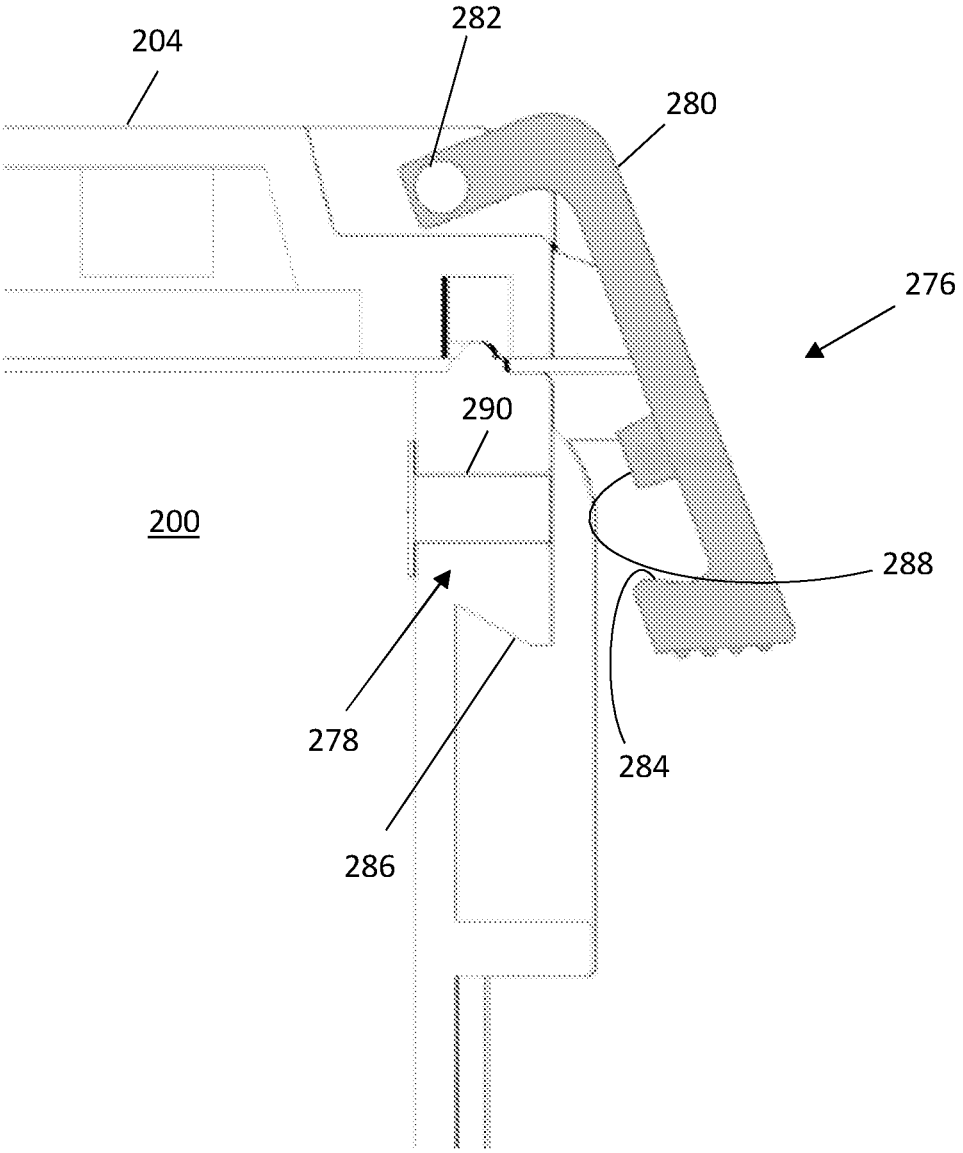
FIG. 14 is a section in a vertical plane through a locking arrangement of the container of FIGS. 8 to 13.

The locking arrangement 276 depicted in FIG. 14 comprises a locking member 280 which is coupled to the lid 204 through a pivot 282 and so is able to be turned by a user between a lock position and an unlock position. In the lock position, and whilst the lid 204 is closed, a latch portion 284 of the locking member 280 engages a complementary latch feature 286 of the container body 202, retaining the lid 204 in its closed position until the locking member 280 is turned to the unlock position, which is depicted in FIG. 14, to release the lid 204.

The locking member 280 carries a bung 288 which faces toward the container body 202 and is positioned to align with an exhaust port 290 which, in the absence of the bung 288, is open to the exterior of the container 200. The exhaust port 290 communicates with the interior of the inflatable dunnage 256. When the lid 204 is closed and the locking member 280 is moved to its lock position, the bung 288 is advanced into the exhaust port 290 to shut it off. Hence pressure is able to be sustained in the inflatable dunnage 256. Moving the locking member 280 to its unlock position withdraws the bung 288 from the exhaust port 290 and so opens the port, releasing pressure from the inflatable dunnage 256 and causing it to deflate. The container 200 thus cannot be opened without deflation of the inflatable dunnage 256.

Figure 15:
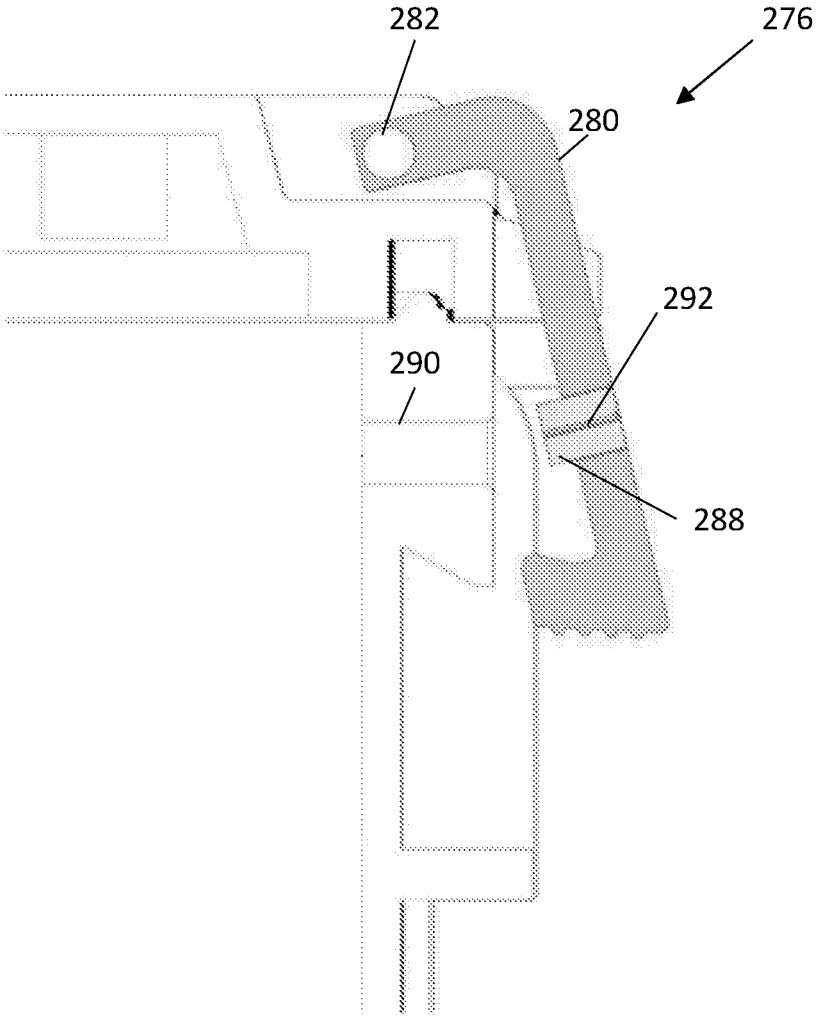
FIG. 15 is a section in a vertical plane through an alternative locking arrangement for the container of FIGS. 8 to 13.

Preparing the container 200 involves first placing content 112 inside, then closing and locking the lid 204, then inflating the dunnage 256 to protect the content 112. An arrangement that permits inflation of the dunnage 256 is depicted in FIG. 15 and comprises an inflation port 292 passing through the bung 288, so that the exhaust port 290 additionally serves as an inflation port. The inflation port 292 is able to close against escape of gas. To this end it may be provided with a one-way valve, but in the present embodiment the inflation port 292 simply comprises a narrow passage through the bung 288 which receives a needle-shaped fitting for inflation, and which seals when that is withdrawn due to its own resilience.

Figure 16:
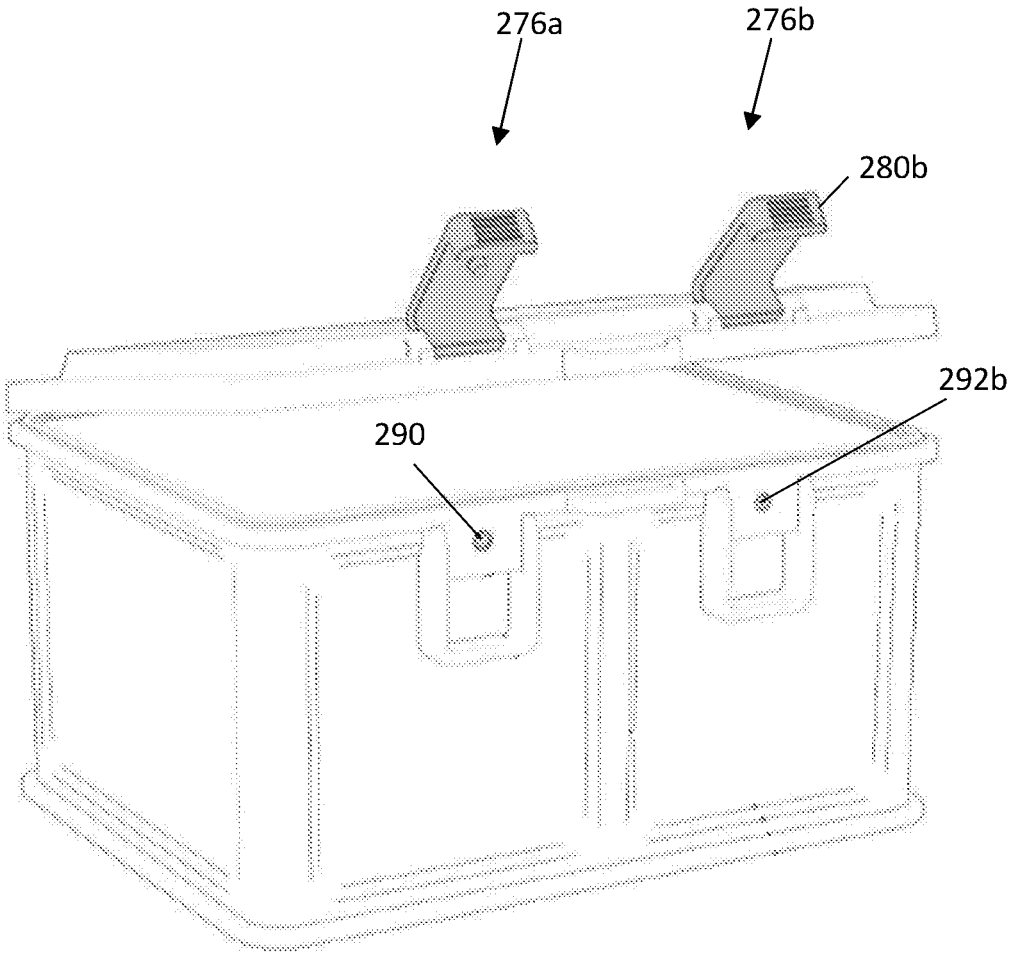
FIG. 16 depicts a further container embodying the present invention.

In other embodiments an inflation port is provided which is separate from the exhaust port 290. FIG. 16 depicts one such arrangement, which in this example uses first and second locking arrangements 276*a*, 276*b*. The first locking arrangement 276*a* is of the type already described and controls shutoff and opening of the exhaust port 290. The second locking arrangement 276*b* incorporates an inflation port 292*b* which is provided with a one-way valve and is protected beneath a locking member 280*b* of the second locking arrangement 276*b* when that is in its locked position. In other embodiments, the inflation port may be disposed on a different region of the exterior of the container 200 and need not be associated with a locking arrangement.

As mentioned above, the locking arrangement 276 may additionally serve to secure the container 200 in its collapsed state. FIG. 10 makes this aspect clear. The locking member 280*c* of this embodiment is seen to have a second latch portion 294 to engage a complementary latch feature of the bottom panel 206. Hence in its locked position the locking member 280*c* couples the lid 204 to the bottom panel 206, preventing them from moving apart and so maintaining the container 200 in the collapsed state. In other embodiments a mechanism separate from the locking arrangement 276 may be provided to secure the container in its collapsed state.

Securing the container 200 in its collapsed state greatly facilitates handling and transportation. Were the container 200 to be wholly or partly erected during the sort of rough handling to which freight is routinely subject, it would be more vulnerable to damage and would take up excessive space.

Components of the container 200 are all configured to engage one another releasably in order that should damage occur to one or more of them, the damaged component(s) are able to be removed and replaced, without undamaged components being wasted.

Figure 17:
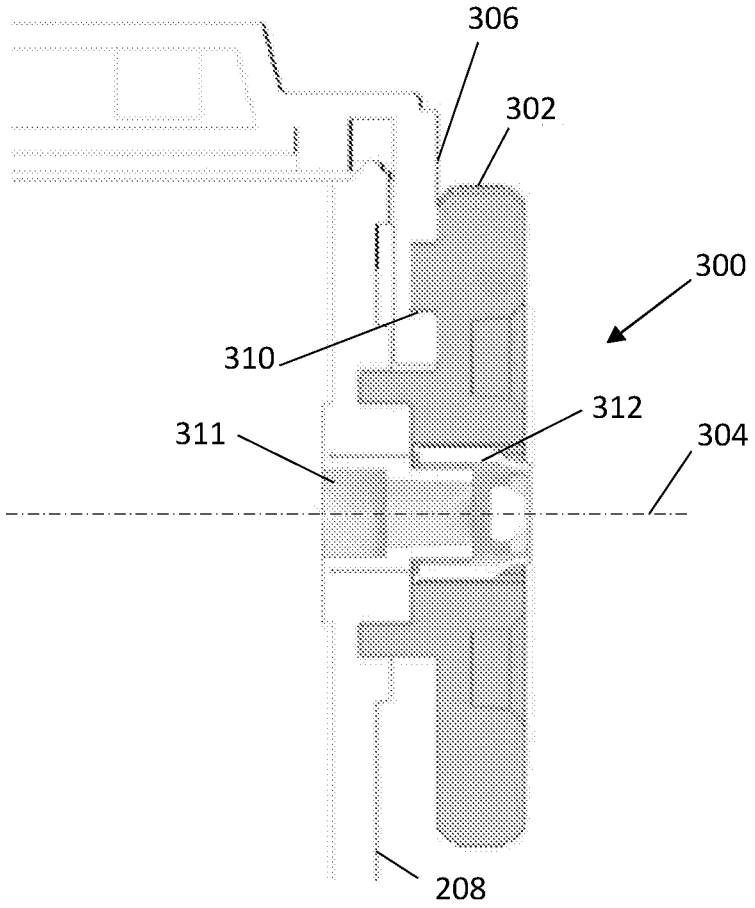
FIG. 17 is a section in a vertical plane through a further locking arrangement for a container embodying the present invention.
Figure 18:
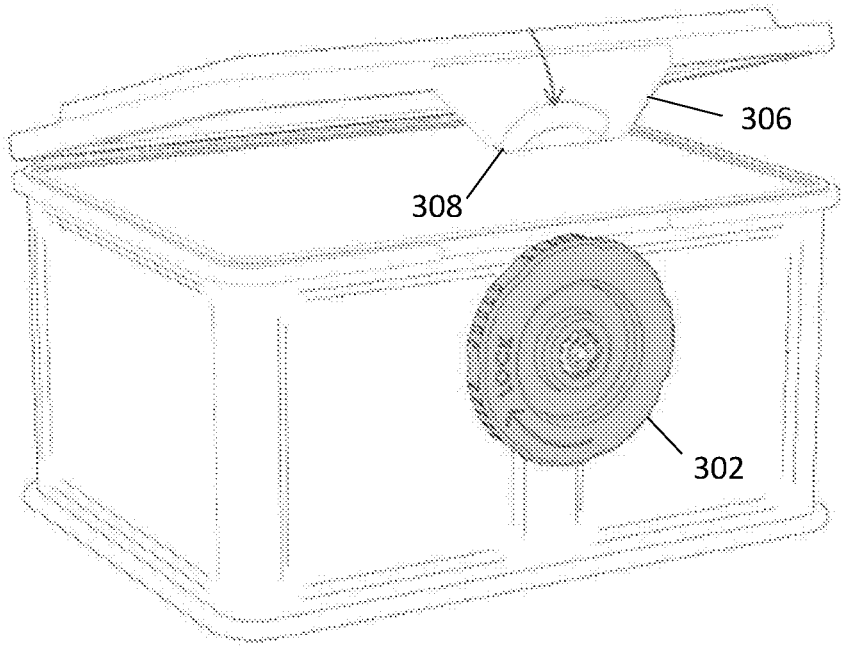
FIG. 18 depicts a container incorporating the locking mechanism of FIG. 17.

FIGS. 17 and 18 depict an alternative form of locking arrangement 300. Here, a movable locking member 302 is carried by one of the side panels 208 of the body 202, rather than by the lid 204 as in earlier embodiments, and is rotatable about an axis 304 substantially perpendicular to the side panel 208 that carries it. A tongue 306 depending from the lid 204 comprises an arcuate slot 308. When the lid 204 is locked, as depicted in FIG. 17, a locking stub 310 on the locking member 302 engages in the slot 308 to provide the locking action. Turning the locking member 302 moves the locking stub 310 out of the slot 308, thereby unlocking the lid 204. An exhaust port 311 lies on the axis 304 and is controlled by a rotary-action valve 312 so that turning the locking member 302 to unlock the lid 204 also causes the valve 312 to open to deflate the inflatable dunnage 256.

Because the container has the same footprint (plan shape) in its use state and in its collapsed state, filled and empty (collapsed) containers 200 are able to be stored alongside one another without waste of space. Collapsed containers may be stacked on filled ones, or vice versa, for example. Further, the depth of the container 200 is chosen to be an integral multiple of the depth of the collapsed container 200. For example, and without limitation, the container 200 may be three times as deep when in use as when collapsed. This further facilitates space-efficient stacking and storage of the containers. For example, shelf space sized to receive an erected container can, without waste of space, instead receive three collapsed containers.

The container 200 may be configured to provide evidence of tampering, and especially of unauthorised opening. For this purpose, and as seen e.g. in FIGS. 9 and 10, the lid 204 and a side panel 208 are, in the present embodiment, provided with openings 314 to receive a breakable member, which may simply comprise a loop (not shown) passed through both openings. The breakable member may for example comprise paper, string, cord or twine. It may comprise a strip of paper with a self-adhesive panel, so that an end of the strip of paper is able to be passed through both openings 314, and then the self-adhesive panel serves to secure one part of the strip to another, forming a loop. The arrangement is such that opening the lid 204 can only be done by breaking the breakable member, or by breaking some other part of the container 200, in a manner which will be conspicuous to a user.

FIGS. 19 to 27 depict further forms that the container body may take. In each case the container body is provided with inflatable dunnage and is capable of being stowed in a manner that minimises bulk. While these drawings are simplified, each of these container bodies may, in accordance with an aspect of the present invention, be provided with a locking arrangement of one of the above-described types, to automatically deflate the inflatable dunnage upon opening of the container.

Figure 19:
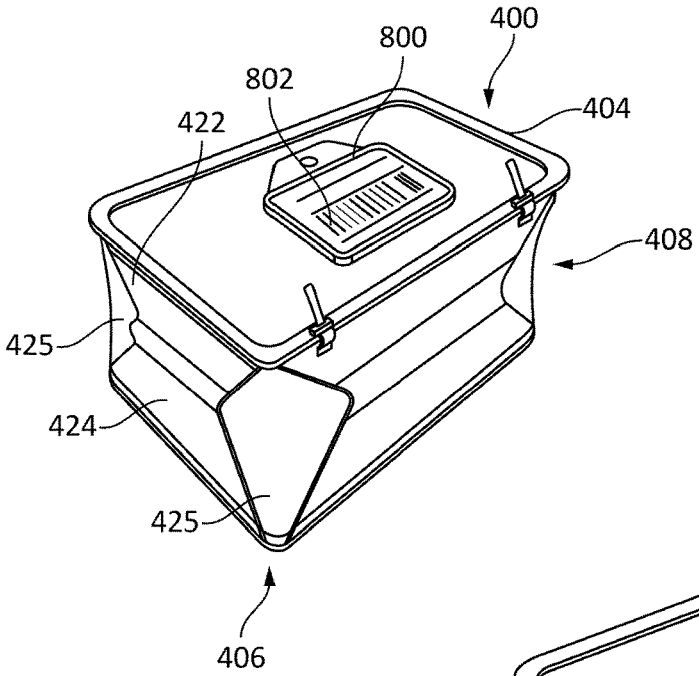
FIGS. 19, 20 and 21 depict another container embodying the present invention in a use configuration with its lid closed, in a collapsed configuration, and in the use configuration with its lid open, respectively.
Figure 20:
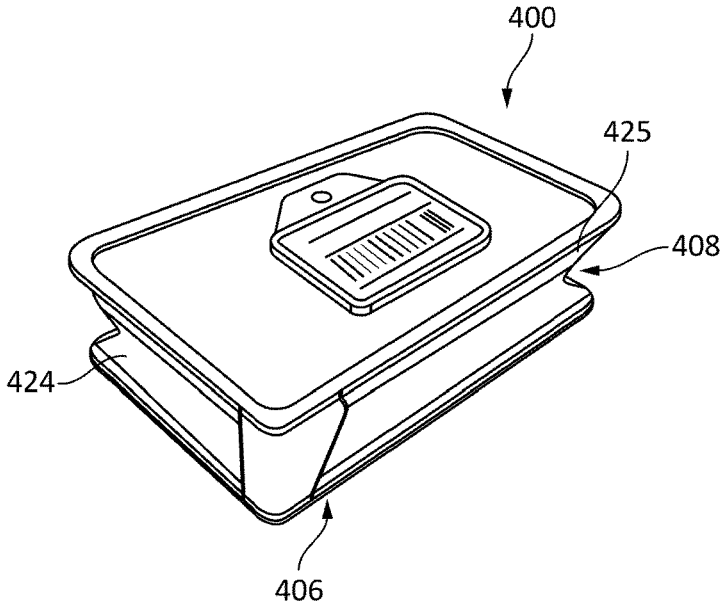
Figure 21:
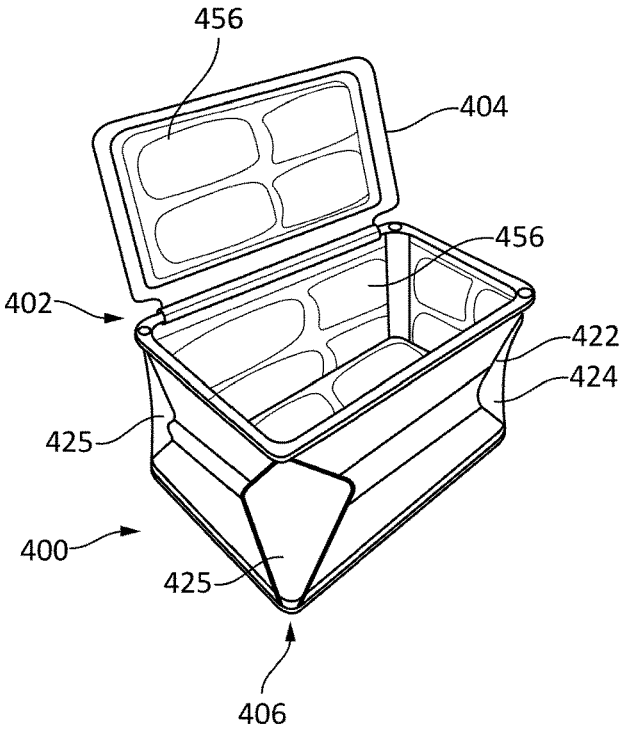

Collapsible container 400 depicted in FIGS. 19 to 21 is similar to container 200 described above in having a lid 404 and a bottom panel 406 connected through side panels 408 each comprising upper and lower subpanels 422, 424. The subpanels 422, 424 turn inwardly as the container 400 collapses (FIG. 20). Whereas container 200 above used an external skirt to form a continuous enclosure, the present container 400 instead has flexible panels 425 at the upright vertices of the container 200 to cover spaces between neighbouring subpanels 422, 424. The flexible panels may form a continuous skirt disposed within the container body 402. Inflatable dunnage is seen at 456.

Figure 22:
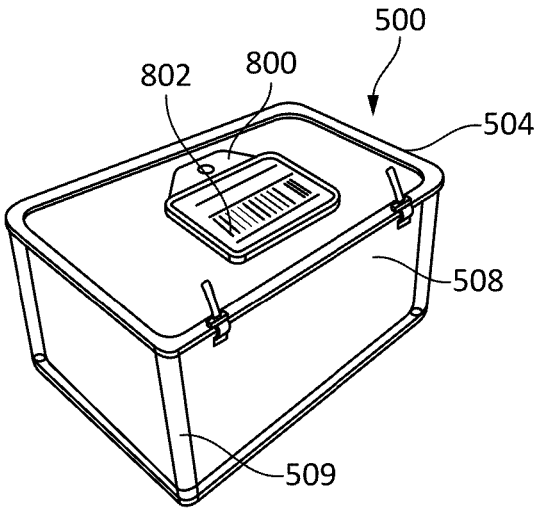
FIGS. 22, 23 and 24 depict another container embodying the present invention with its lid closed, with its lid and bottom panel both open, and with its lid only open, respectively.
Figure 23:
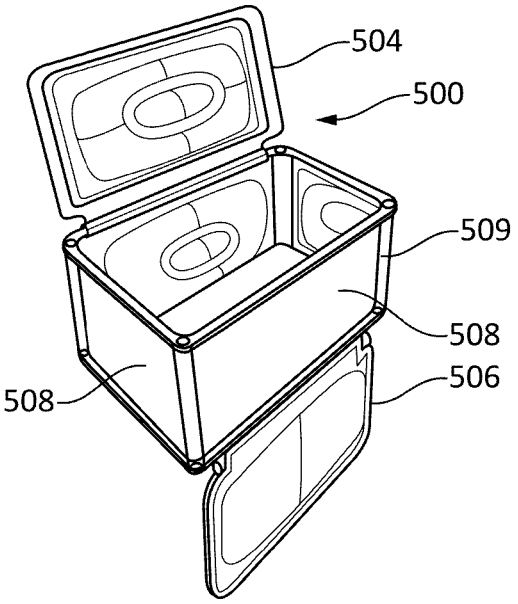
Figure 24:
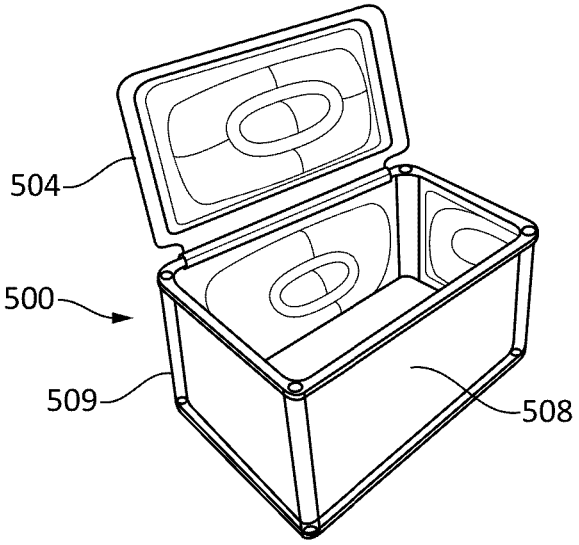

Collapsible container 500 depicted in FIGS. 22 to 24 is similar to container 200 described above in having a lid 504 and a bottom panel 506 connected through side panels 508. But in container 500 both the lid 504 and the bottom panel 506 are hingedly coupled to the side panels 508-FIG. 23 shows both of them opened. The side panels are coupled to one another at upright vertices 509 which allow the side panels 508 to turn relative to one another The container 500 is to be collapsed by opening the lid 504 and the bottom panel 506, and then turning the side panels to for a flat, collapsed state.

Figure 25:
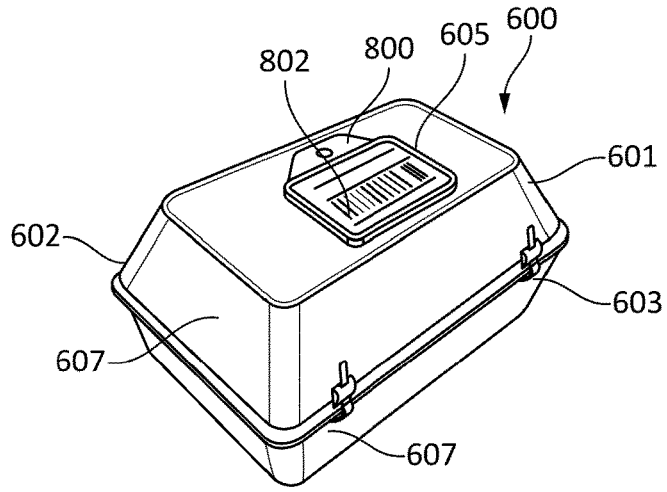
FIGS. 25, 26 and 27 depict another container embodying the present invention.
Figure 26:
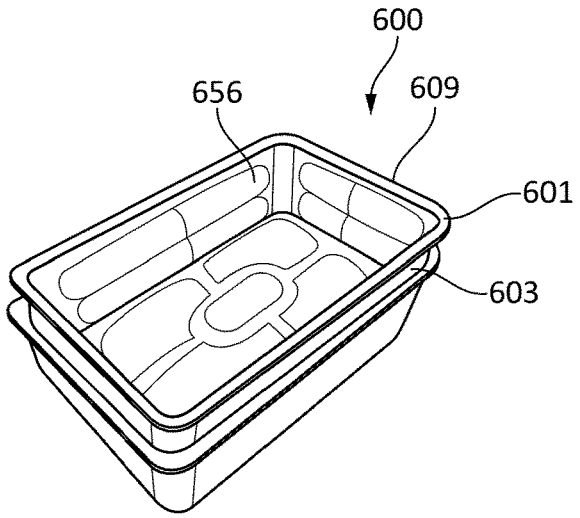
Figure 27:
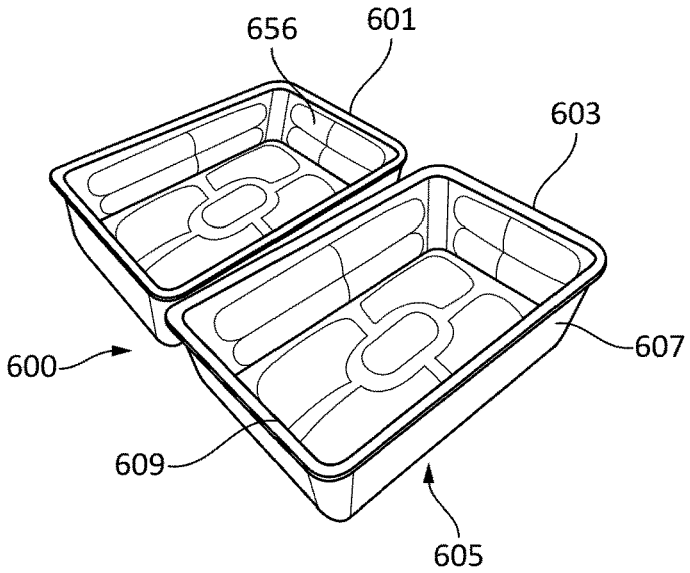

The container 600 depicted in FIGS. 25 to 27 is stackable rather than collapsible. Its container body 602 comprises upper and lower body parts 601, 603 each comprising a base panel 605 and side walls 607 which diverge somewhat in a direction away from the base panel 605, forming a tray-like structure. The upper and lower body parts 601, 603 are configured to be attached to one another through respective peripheral flanges 609 to form the container body, as in FIG. 25, and each contains inflatable dunnage 656. The upper and lower body parts are separable from each other as depicted in FIG. 27 and are shaped to enable them to be stacked one within another, as in FIG. 26, so that multiple similarly-formed containers 600 can be transported in a stack with greatly reduced volume, compared to the assembled containers. The deflated dunnage 656 remains in the body parts 601, 603 but adds little to the depth of the resultant stack.

Figure 28:
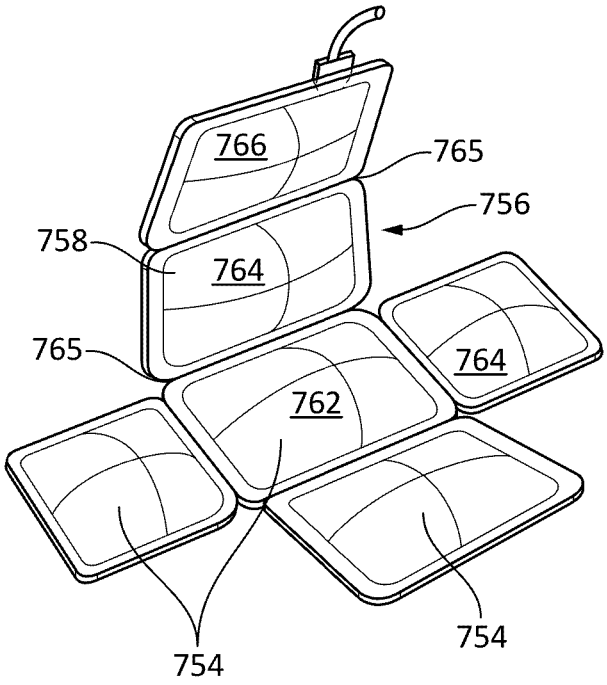
FIG. 28 depicts a further form of inflatable dunnage for use in containers embodying the present invention.
Figure 29:
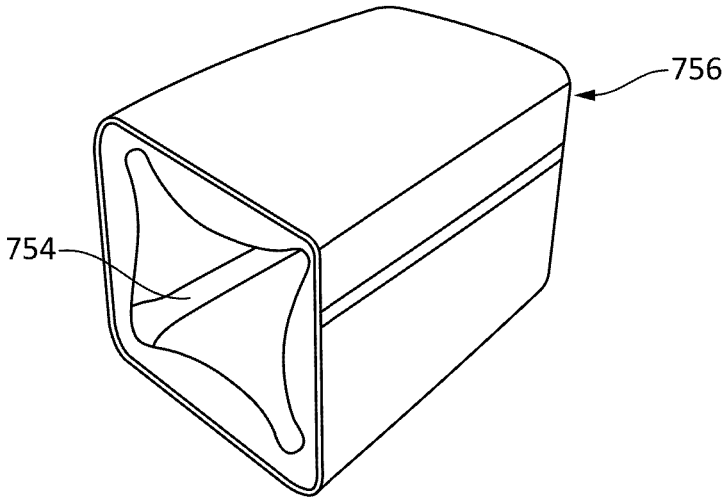
FIG. 29 depicts the inflatable dunnage of FIG. 28 folded to fit into a container embodying the present invention.

FIGS. 28 and 29 depict an alternative form of inflatable dunnage 756. This is once more formed from a pair of flexible skins 758 selectively seamed to form inflatable cells 754 and has a bottom dunnage panel 762, side dunnage panels 764 and a top dunnage panel 766 coupled through seam lines 765 forming living hinges between the dunnage panels.

The interior of containers of any of the above-described types may be partitioned using inflatable dunnage to form internal walls which are able to collapse when deflated, so that the partitions, when deflated, do not prevent the container from being stacked or collapsed.

An obstacle to reuse of conventional containers, and especially of delivery containers, is the labels that are applied to them, which are usually specific to a particular journey or function and which often need to be removed or at least obscured prior to reuse. The problem is addressed in accordance with the present invention by providing any or all of the above-described containers 100, 200, 400, 500, 600, 700 with a display module 800 comprising a rewritable display 802. Specifically, the display 802 is electronically controlled. Any suitable current or future display technology may be used, but low power displays are well suited to this application since information may need to be displayed for a protracted period and provision of a large energy store is undesirable. A bistable display, capable of maintaining its display with minimal or even zero power input, may be used.

Suitable display technologies include LCDs, electrophoretic displays and electrochromic displays.

The invention imposes no particular limitation on the nature of the displayed information but it may for example include, but is not limited to, shipping labels, transit labels, carrier's operational labels, customs and waybill-type information, and content-related information such as dimensions of the content 112, weight of the content 112, and/or type of the content 112. It may for example indicate that the content 112 comprises hazardous material, is fragile, is heavy, contains batteries or other material presenting a risk of explosion, or is inflammable.

The display module 800 may be configured to communicate with a separate computing device which may take any suitable form including without limitation a mobile phone, laptop, computer or computer network. Communication may be through an unwired connection, e.g. a connection conforming to conforming to the WiFi® or Bluetooth® standards. The channel used for communication may be secured through encryption and/or through other means known to the skilled person and may allow a user or system to enter and/or update or configure the information on the display module 802.

The display module 800 makes it unnecessary to apply to the container 100, 200, 400, 500, 600, 700 stickers or hand-written information such as address labels, shipping labels, customs, and other declaration papers. Because the container 100, 200, 400, 500, 600, 700 is able to be locked in a closed configuration it also does not need to be closed with adhesive tape or other materials that would need to be removed prior to reuse. Consequently the container 100, 200, 400, 500, 600, 700 is able to reduce the usage and requirement of non-recyclable and non-reusable components, thereby reducing energy footprint and environmental issues.

In interpreting the specification, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Terms relating to height or relative height, such as "top", "bottom", "upper" and "lower", are used in both the description and the claims for the sake of convenience but of course the container may be placed in any orientation.

While the foregoing describes various embodiments of the invention, other and further embodiments of the invention may be devised without departing from the basic scope thereof. The scope of the invention is determined by the claims that follow. The invention is not limited to the described embodiments, versions or examples, which are included to enable a person having ordinary skill in the art to make and use the invention when combined with information and knowledge available to the person having ordinary skill in the art.

The invention claimed is:

1. A container comprising:

a container body which is reversibly and repeatedly reconfigurable between a use state in which the container body forms an internal cavity for receiving content and has an opening through which the content is able to be inserted to and removed from the internal cavity, and a collapsed state in which an internal volume of the internal cavity is reduced compared with the use state;

a closure which is movable with respect to the container body between a closed position in which it closes the opening and an open position in which the opening is uncovered;

a locking member which is (a) movable from an unlock position to a lock position to lock the closure in the closed position and (b) movable from the lock position to the unlock position to unlock the closure and enable the closure to be moved to the open position;

an inflatable dunnage disposed in the internal cavity and configured to be inflated by injection of gas or liquid;

an exhaust port communicating with the inflatable dunnage; and an exhaust port shutoff arrangement having a closed state in which the exhaust port shutoff arrangement closes the exhaust port and an open state in which the exhaust port shutoff arrangement opens the exhaust port, and wherein the locking member is configured to cooperate mechanically with the exhaust port shutoff arrangement such that moving the locking member from the lock position to the unlock position causes the exhaust port shutoff arrangement to change from the closed state to the open state, whereby pressure in the inflatable dunnage is automatically released through the exhaust port prior to opening the container, and such that moving the locking member from the unlock position to the lock position causes the exhaust port shutoff arrangement to change from the open state to the closed state.

2. The container as claimed in claim 1, wherein the locking member is rotatably coupled to one of the container body and the closure.

3. The container as claimed in claim 1, wherein the exhaust port shutoff arrangement comprises a bung carried on the locking member and arranged to be inserted into the exhaust port by an action of moving the locking member to the lock position, and to be withdrawn from the exhaust port by the action of moving the locking member to the unlock position.

4. The container as claimed in claim 3, wherein the bung incorporates an inflation port through which the inflatable dunnage is able to be inflated whilst the bung is in the exhaust port.

5. The container as claimed in claim 1, wherein an inflation port separate from the exhaust port communicates with the inflatable dunnage for injection of gas thereto.

6. The container as claimed in claim 2, wherein the exhaust port shutoff arrangement comprises a rotary-action valve coupled to the locking member such that rotary movement of the locking member opens and closes the rotary rotary-action valve.

7. The container as claimed in claim 1, wherein the closure comprises a lid hingedly coupled to the container body for movement between the closed position and the open position.

8. The container as claimed in claim 1, wherein the container body comprises:

an upper panel, a bottom panel, and a plurality of collapsible side walls connecting the upper panel to the bottom panel, the side walls being upright in the use state so that the internal volume is defined between the upper panel, the bottom panel and the side walls, and the side walls being collapsed in the collapsed state to move the upper panel toward the bottom panel.

9. The container as claimed in claim 1, further comprising a rewritable electronic display visible at its exterior.

10. The container as claimed in claim 9, wherein the electronic display is part of a display module configured to communicate with a computing device through a secure communication channel through which information to be displayed is transmissible to the display module.

11. The container as claimed in claim 1, further comprising upper registration features and complementary lower registration features configured such that when two identically formed containers are stacked one upon the other, the upper registration features of one container register with the lower registration features of the other container to maintain the two containers in orderly alignment.

12. The container as claimed in claim 1, wherein the closure and the container body are separable and, when assembled to one another, define the internal volume, and at least one of the closure and the container body being configured to be stacked with other identically formed closures or container bodies one within another.

13. The container as claimed in claim 12, wherein at least one closure and/or at least one container body comprises a base panel with upstanding peripheral walls which diverge from one another in a direction away from the base panel.

14. The container as claimed in claim 1, wherein the container body further comprises:

an upper panel;

a bottom panel; and a plurality of collapsible side walls connecting the upper panel to the bottom panel, and wherein the side walls are upright in the use state so that the internal cavity is defined between the upper panel, the bottom panel and the side walls into which content is insertable through the opening, and the side walls being collapsed in the collapsed state to move the upper panel toward the bottom panel thereby reducing the volume of the container.

15. The container as claimed in claim 1, wherein the inflatable dunnage is secured or tethered to the container body such as to collapse along with it, when deflated, and to fold in an orderly fashion.

16. A container as claimed in claim 14, wherein at least one of the side walls comprises an upper side-wall panel and a lower side-wall panel, the upper side-wall panel having an upper edge which is hingedly connected to the upper panel and a lower edge which is hingedly connected to an upper edge of the lower side-wall panel, the lower side-wall panel having a lower edge which is hingedly connected to the bottom panel.

17. The container as claimed in claim 1, wherein the container has a depth in the use state which is substantially an integral multiple greater than its depth in the collapsed state.

18. A container as claimed in claim 1, wherein the container is provided with a user-operable and releasable mechanism for locking the container in the collapsed state.

19. A container comprising:

a container body which is reversibly and repeatedly reconfigurable between a use state in which the container body forms an internal cavity for receiving content and has an opening through which the content is able to be inserted to and removed from the internal cavity, and a collapsed state in which an internal volume of the internal cavity is reduced compared with the use state;

a closure which is movable with respect to the container body between a closed position in which it closes the opening and an open position in which the opening is uncovered;

a locking member which is movable between a lock position and an unlock position and which is configured, when in the lock position to mechanically lock the closure in a closed position, the locking member being configured to release the closure when moved to the unlock position to enable the closure to be moved to an open position;

an inflatable dunnage disposed in the internal cavity and configured to be inflated by injection of gas or liquid;

an exhaust port communicating with the inflatable dunnage; and an exhaust port shutoff arrangement having a closed state in which the exhaust port shutoff arrangement closes the exhaust port and an open state in which the exhaust port shutoff arrangement opens the exhaust port, and wherein the locking member is configured to cooperate mechanically with the exhaust port shutoff arrangement such that moving the locking member from the lock position to the unlock position causes the exhaust port shutoff arrangement to change from the closed state to the open state, whereby pressure in the inflatable dunnage is automatically released through the exhaust port prior to opening the container:

the closure is configured when in the closed position to prevent access to the internal cavity; and, with the container in its collapsed state, the locking member is configured to lock the container in the collapsed state when in the lock position and to release the container and enable to the container be reconfigured to the use state when in the unlock position.

20. A container comprising:

a container body which is reversibly and repeatedly reconfigurable between a use state in which the container body forms an internal cavity for receiving content and has an opening through which the content is able to be inserted to and removed from the internal cavity, and a collapsed state in which an internal volume of the internal cavity is reduced compared with the use state;

a closure which is movable with respect to the container body between a closed position in which it closes the opening and an open position in which the opening is uncovered;

a locking member which is movable between a lock position and an unlock position and which is configured, when in the lock position to mechanically lock the closure in a closed position, the locking member being configured to release the closure when moved to the unlock position to enable the closure to be moved to an open position;

an inflatable dunnage disposed in the internal cavity and configured to be inflated by injection of gas or liquid;

an exhaust port communicating with the inflatable dunnage; and an exhaust port shutoff arrangement having a closed state in which the exhaust port shutoff arrangement closes the exhaust port and an open state in which the exhaust port shutoff arrangement opens the exhaust port, and wherein the locking member is configured to cooperate mechanically with the exhaust port shutoff arrangement such that moving the locking member from the lock position to the unlock position causes the exhaust port shutoff arrangement to change from the closed state to the open state, whereby pressure in the inflatable dunnage is automatically released through the exhaust port prior to opening the container, the exhaust port shutoff arrangement comprising a bung carried on the locking member and arranged to be inserted into the exhaust port by an action of moving the locking member to the lock position, and to be withdrawn from the exhaust port by the action of moving the locking member to the unlock position, the bung incorporating an inflation port through which the inflatable dunnage is able to be inflated whilst the bung is in the exhaust port.

* * * * *